US012345500B2

(12) United States Patent
Chia

(10) Patent No.: US 12,345,500 B2
(45) Date of Patent: Jul. 1, 2025

(54) HIGH PERFORMANCE LAUNCHER OF SHORT PROJECTILES WITH PISTON NOZZLE SPRING

(71) Applicant: EASEBON SERVICES LIMITED, Kwun Tong (HK)

(72) Inventor: Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

(21) Appl. No.: 18/265,619

(22) PCT Filed: May 5, 2021

(86) PCT No.: PCT/SG2021/050250

§ 371 (c)(1),
(2) Date: Jun. 6, 2023

(87) PCT Pub. No.: WO2022/132031

PCT Pub. Date: Jun. 23, 2022

(65) Prior Publication Data

US 2024/0044609 A1 Feb. 8, 2024

Related U.S. Application Data

(60) Provisional application No. 63/127,442, filed on Dec. 18, 2020.

(51) Int. Cl.
*F41B 11/89* (2013.01)
*F41B 11/54* (2013.01)
(Continued)

(52) U.S. Cl.
CPC ..... *F41B 11/89* (2013.01); *F41B 11/54* (2013.01); *F41B 11/646* (2013.01); *F41B 11/73* (2013.01)

(58) Field of Classification Search
CPC . F41B 11/54; F41B 11/64–642; F41B 11/646; F41B 11/73; F41B 11/89
(Continued)

(56) References Cited

U.S. PATENT DOCUMENTS 4,843,751 A 7/1989 Ferri
5,522,374 A * 6/1996 Clayton ..... F41B 11/646 124/66

(Continued)

FOREIGN PATENT DOCUMENTS

JP 2005265348 A 9/2005

OTHER PUBLICATIONS

Merged document: JP 2005-265348 A, Mar. 19, 2004, all (Year: 2004).*

(Continued)

*Primary Examiner* — Bret Hayes
(74) *Attorney, Agent, or Firm* — Amster, Rothstein & Ebenstein LLP

(57) ABSTRACT

A toy projectile launcher having a projectile container, a cocking slide, and a housing is disclosed. The projectile container contains projectile holders that are adapted to hold a projectile, such as a foam dart. The cocking slide can be moved forward and backward. The housing houses a launch barrel and an air piston assembly. When the cocking slide is moved backward the air piston barrel moves backward, and a projectile holder is moved into a firing position. The foam dart is held in place by a resilient stopper. When the cocking slide is moved forward an air nozzle engages a surface of the resilient stopper and advances through the projectile holder, pushing the foam dart into the launch barrel. An airtight seal is formed between the launch barrel and air piston assembly.

27 Claims, 21 Drawing Sheets

(51) Int. Cl.
*F41B 11/646* (2013.01)
*F41B 11/73* (2013.01)

(58) Field of Classification Search
USPC ..... 124/63–67, 45, 48
See application file for complete search history.

(56) References Cited

U.S. PATENT DOCUMENTS

| | | | | |
|---|---|---|---|---|
| 5,878,734 | A | 3/1999 | Johnson et al. | |
| 9,239,206 | B1 * | 1/2016 | Nguyen | F41B 11/646 |
| 9,534,865 | B1 | 1/2017 | Clayton | |
| 2006/0266342 | A1 | 11/2006 | Teipel et al. | |
| 2010/0229844 | A1 | 9/2010 | Gore | |
| 2011/0041824 | A1 * | 2/2011 | Jablonski | F41B 11/89 124/65 |
| 2019/0346231 | A1 | 11/2019 | Ma et al. | |
| 2020/0309482 | A1 | 10/2020 | Bernal | |

OTHER PUBLICATIONS

International Search Report issued in PCT/SG2021/050250, mailed Aug. 16, 2021.
Written Opinion issued in PCT/SG2021/050250, mailed Aug. 16, 2021.
European Search Report issued in Application No. 21907251.9, dated Oct. 14, 2024.
Communication pursuant to Rules 70(2) and 70a(2) EPC issued in Application No. 21907251.9, dated Oct. 31, 2024.

* cited by examiner

100

1505

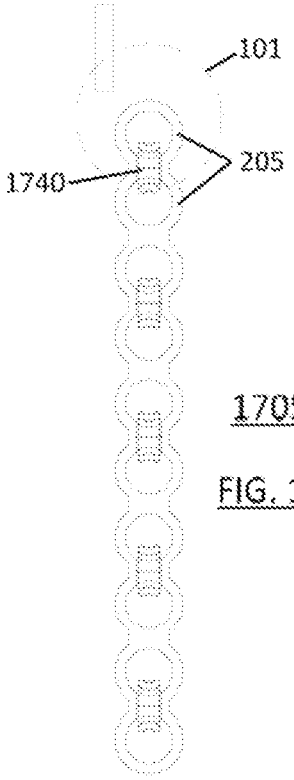
1705
FIG. 18A
FIG. 18B
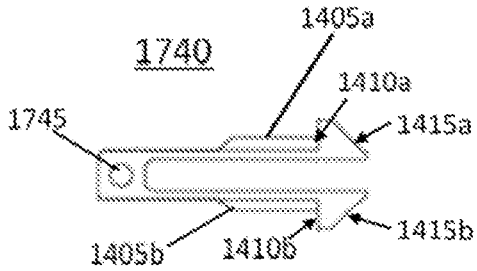
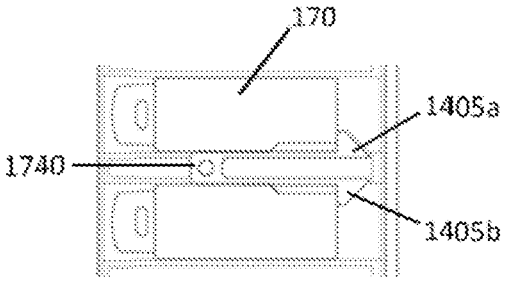
1705
FIG. 18C

1000

1000

HIGH PERFORMANCE LAUNCHER OF SHORT PROJECTILES WITH PISTON NOZZLE SPRING

REFERENCE TO OTHER APPLICATIONS

This application is a U.S. national phase claiming priority to and the benefit of PCT Application No. PCT/SG2021/050250, filed May 5, 2021 and entitled "HIGH PERFORMANCE LAUNCHER OF SHORT PROJECTILES WITH PISTON NOZZLE SPRING," which in turn claims the benefit of and priority to U.S. Provisional Patent Application No. 63/127,442, filed on Dec. 18, 2020, entitled "HIGH PERFORMANCE LAUNCHER OF SHORT PROJECTILES WITH PISTON NOZZLE SPRING," the contents of which are incorporated herein by reference in their entirety.

FIELD

The present disclosure is generally related to a toy projectile launcher, such as a toy pistol, gun, and the like, for launching toy projectiles, such as foam bullets, darts, balls, and the like, with a simplified construction and improved performance.

BACKGROUND

Traditional toy projectile launchers have utilized various forms of rifles, pistols, blasters, machine guns, and the like, for launching toy projectiles, such as foam balls and darts. Such toy launchers have varied, for example, in size, power, and storage capacity. More specifically, toy launchers of foam projectiles—bullets (or "darts"), balls, and the like—have become ubiquitous. One standard for foam bullets has been marketed under the brand name Nerf® with a rubber tip and a foam body that totals approximately 71.5 mm in length. There have been various types of rifles, machine guns, and the like, that have been marketed for launching such foam projectiles.

The caps of the toy darts are generally made of a material other than foam that allows the dart to be shot from the launcher at a targeted person or object and/or propelled over an appropriate distance at a relatively quick speed.

Conventional dart guns have traditionally been marketed to pre-teen children for casual play. More recently, in conjunction with the advent of special event war games—such as paintball, laser tag, and the like—more high-powered launchers have been developed to target enthusiasts for such special events using foam darts.

As an example, launchers having metal barrels, instead of plastic ones, have been used for improved launching velocity. Such launchers and darts are usually dimensioned to have a very small clearance between the inner diameter of the barrel of the launcher and the outer diameter of the dart so as to provide improved launching speed and accuracy.

With the above-mentioned metal-barreled launchers, there is still a need to further improve the launching force of the projectiles.

SUMMARY

To address the above, the present disclosure is generally related to an improved toy launcher for launching high performance foam darts. According to an exemplary embodiment of the present disclosure, one or more sealing mechanisms are provided to improve airtight seals from an air piston mechanism to a launch barrel of a toy projectile launcher. To that end, a launcher may include a mechanism for priming a high performance foam dart from a storage compartment into a firing position in a launch barrel while forming an airtight seal between an air piston nozzle and the launch barrel, thus improving the launch force on the primed dart. For example, co-pending U.S. Patent Application Nos. 63/020,086 and 63/112,213 disclose respective launchers in pistol configurations that include a mechanism for priming darts stored in a storage handle or a cartridge into a firing position in the launch barrel of the pistol launchers. (The contents of U.S. Patent Application Nos. 63/020,086 and 63/112,213 are incorporated herein by reference.) In the disclosed launchers, an air piston assembly is movable by a cocking slide in a two-step loading/priming motion, where the air piston assembly retracts upon pulling back on the cocking slide, which allows a top dart in the storage compartment (handle or cartridge) to be lifted to a position in front of the air piston assembly and where the air piston assembly pushes forward, upon a push forward on the cocking slide, so that a front air nozzle of the air piston assembly pushes the top dart into the launch barrel and forms an airtight seal with the launch barrel behind the primed dart.

While such pistol launchers provide improved launching force and accuracy, in play, hobbyists would prefer a large capacity blaster. Larger storage capacities would extend their blasting between reloadings. However, a magazine clip or storage handle can only be extended up to a point; beyond which, it would become unwieldy, due to its length. Co-pending U.S. Patent Application No. 63/066,389 discloses a launcher in a submachine gun configuration that incorporates a feeding mechanism for priming darts stored in a cartridge that is received in the launcher in a parallel direction to a firing direction of the launcher. (The contents of U.S. Patent Application No. 63/066,389 are incorporated herein by reference.) Accordingly, this submachine gun launcher provides for a higher capacity magazine clip that does not extend orthogonally from the launcher and, therefore, provides higher capacity without becoming unwieldly. Still, all of the high-performance launchers with dart priming and launch barrel seals can still only hold 20 darts at most.

To address the above, the present disclosure provides for a mechanism to accommodate an air piston nozzle that reaches through a storage drum to prime darts stored in the storage drum and to form an airtight seal with a launch barrel in front of the storage drum. Advantageously, an effective and high-performance blaster may be realized that provides high velocity and accurate projectile launching while allowing for a high capacity storage drum. The present disclosure provides for a resilient mechanism that holds each foam dart in place in a storage area without necessitating any reduction of the diameter of the drum cylinders normally resulting from the incorporation of a retaining wall at the rear of each dart holding cylinder in a conventional storage drum. The resilient mechanism allows an air piston nozzle having a maximum diameter that enables the air piston nozzle to reach through the storage area and to form a sealed connection with the launch barrel. The use of an air piston nozzle that is sufficiently large in cross section enables the nozzle to form a direct airtight connection to the launch barrel.

In particular, the present disclosure is directed to a toy launcher with a simple construction for an improved integrated launcher with a two-step loading/priming and firing mechanism that incorporates improved airtight seals among elements of the launcher for realizing high launching force for compact projectiles and allows for a higher capacity storage drum.

According to an exemplary embodiment, the toy launcher includes a projectile holder, a launch barrel, an air piston assembly, and a cocking slide, wherein at least the projectile holder and the air piston assembly are coupled to the cocking slide.

According to an exemplary embodiment, the air piston assembly includes an air piston barrel, a plunger element, and a compression spring.

In embodiments, the toy launcher includes a coupling between the cocking slide and the air piston barrel.

In embodiments, the air piston barrel is movable to a backward position when the cocking slide is moved to the backward position.

In embodiments, a front portion of the air piston barrel pushes the plunger element to compress the compression spring against the rear wall of the toy launcher when the cocking slide is moved to the backward position.

In embodiments, the projectile holder includes a projectile advancement mechanism for advancing a next loaded projectile in the projectile holder into a priming position in front of the air piston barrel.

In embodiments, the projectile holder includes a plurality of resilient projectile stoppers that each abut a portion of a respective projectile loaded in the projectile holder.

In embodiments, the plunger element and the air piston barrel form an internal air chamber when the cocking slide is moved from the backward position to a forward position.

In embodiments, a front portion of the air piston barrel includes an air nozzle, wherein the air nozzle is moved forward to form an airtight seal between the air piston barrel and a launch barrel when the cocking slide is moved from the backward position to the forward position.

In embodiments, each of the resilient projectile stoppers includes a surface disposed to face and be pushed by the front air nozzle when the air piston barrel is pushed forward by a return of the cocking slide from the backward portion to the forward position.

In embodiments, each resilient projectile stopper, when pushed by the front air nozzle, flexes outward to make way for front nozzle to extend through the projectile holder.

In embodiments, the front air nozzle connects to the launch barrel through the projectile holder when the cocking slide is moved to the forward position.

In embodiments, the front air nozzle forms an airtight connection to the launch barrel via an airtight seal with a barrel interface section connected to the launch barrel when the cocking slide is in the forward position.

In embodiments, the front air nozzle pushes a next loaded projectile from the projectile holder into a firing position in the barrel interface section in front of the airtight seal.

In embodiments, the plunger element is pushed forward by the compression spring to expel the air from the internal air chamber through the front air nozzle on the front portion of the air piston barrel behind the next loaded projectile in the firing position when the coupling of the latching assembly between the plunger element and the trigger assembly is released.

In embodiments, in the firing position, the air nozzle on the front end of the air piston barrel is immediately adjacent the projectile.

In embodiments, a toy projectile launcher comprises a projectile container containing a plurality of projectile holders, each projectile holder configured to contain a loaded projectile, wherein the projectile container includes a plurality of resilient projectile stoppers, wherein each resilient projectile stopper abuts a portion of a respective projectile loaded in a respective projectile holder; a cocking slide that is adapted to be moved forward and backward; and a housing, the housing having disposed therein: a launch barrel; an air piston assembly, the air piston assembly including an air piston barrel having an air nozzle disposed on a front portion thereof, a plunger element, and a compression spring; wherein the projectile container, the launch barrel, and the air piston assembly are each coupled to the cocking slide; wherein, when the cocking slide is moved backward from a forward position to a back-ward position: a front portion of the air piston barrel moves backward and pushes the plunger element to compress the compression spring against a rear wall of the housing, wherein the plunger element and compression spring are held in place by a latching mechanism; and a projectile advancement mechanism engages the projectile container and advances a next projectile holder containing a loaded projectile into a firing position in front of the air piston barrel; and wherein, when the cocking slide is moved forward from the backward position to the forward position: the front portion of the air piston barrel moves forward, forming an internal air chamber between the front portion of the air piston barrel and the plunger element; and the air nozzle moves forward to form an airtight seal between the air piston barrel and the launch barrel, wherein a front portion of the air nozzle engages a trailing surface of one of the plurality of resilient projectile stoppers, wherein, upon said engagement by the front portion of the air nozzle, the one of the plurality of resilient projectile stoppers flexes outward to allow the front portion of the air nozzle to extend through the next projectile holder, wherein the front portion of the air nozzle pushes the loaded projectile in the next projectile holder from the next projectile holder into the launch barrel, and wherein the front portion of the air nozzle connects to the launch barrel to form an airtight seal between the air piston barrel and the launch barrel.

In embodiments, the front portion of the air nozzle pushes the loaded projectile from the next projectile holder into a firing position in front of the air-tight seal between the launch barrel and the air piston barrel.

In embodiments, the plunger element is sized to form an airtight seal with an internal surface of the air piston barrel.

In embodiments, the plunger element incorporates a resilient O-ring to form the airtight seal between the plunger element and the internal surface of the air piston barrel.

In embodiments, the internal surface of the air piston barrel has incorporated thereon a resilient ring, wherein the resilient ring forms an airtight seal be-tween the plunger element and the internal surface of the air piston barrel.

In embodiments, the plurality of resilient projectile stoppers comprises a plurality of S-shaped cantilever springs.

In embodiments, the latching assembly is coupled between the plunger element and a trigger assembly, wherein the trigger assembly is adapted to be pulled backward by a user of the toy projectile launcher.

In embodiments, when the trigger assembly is pulled backward, the coupling of the latching assembly between the plunger element and trigger assembly is released, and the plunger element is pushed forward by the compression spring to expel air from the internal air chamber through the air nozzle disposed on the front portion of the air piston barrel behind the loaded projectile in the firing position.

In embodiments, the projectiles are foam darts.

In embodiments, a toy projectile launcher comprises a projectile container containing a plurality of projectile holders, each projectile holder configured to contain a loaded projectile, wherein the projectile container includes a plurality of resilient projectile stoppers, wherein each resilient projectile stopper abuts a portion of a respective projectile loaded in a respective projectile holder; a cocking slide that is adapted to be moved forward and backward; and a housing, the housing having disposed therein: a launch barrel; a launch barrel interface section coupled to the launch barrel; and an air piston assembly, the air piston assembly including an air piston barrel having an air nozzle disposed on a front portion thereof, a plunger element, and a compression spring; wherein the projectile container, the launch barrel, and the air piston assembly are each coupled to the cocking slide; wherein, when the cocking slide is moved backward from a forward position to a back-ward position: a front portion of the air piston barrel moves backward and pushes the plunger element to compress the compression spring against a rear wall of the housing, wherein the plunger element and compression spring are held in place by a latching mechanism; and a projectile advancement mechanism engages the projectile container and advances a next projectile holder containing a loaded projectile into a firing position in front of the air piston barrel; and wherein, when the cocking slide is moved forward from the backward position to the forward position: the front portion of the air piston barrel moves forward, forming an internal air chamber between the front portion of the air piston barrel and the plunger element; and a front portion of the air nozzle forms an airtight connection with the launch barrel via an airtight seal between the launch barrel interface section and the front portion of the air nozzle, wherein the front portion of the air nozzle engages a trailing surface of one of the plurality of resilient projectile stoppers, wherein, upon said engagement by the front portion of the air nozzle, the one of the plurality of resilient projectile stoppers flexes outward to allow the front portion of the air nozzle to extend through the next projectile holder, wherein the front portion of the air nozzle pushes the loaded projectile in the next projectile holder from the next projectile holder into the launch barrel interface section.

In embodiments, the front portion of the air nozzle pushes the loaded projectile from the next projectile holder into a firing position in the launch barrel interface section in front of the airtight seal between the launch barrel interface section and the air nozzle.

In embodiments, the launch barrel interface section has a rounded taper at a rear trailing interior edge thereof.

In embodiments, the air nozzle has incorporated thereon an O-ring around an outer circumference of the air nozzle, wherein the O-ring of the air nozzle forms a seal around an internal circumference of the launch barrel interface section.

In embodiments, the plunger element is sized to form an air-tight seal with an internal surface of the air piston barrel.

In embodiments, the plunger element incorporates a resilient O-ring to form the airtight seal between the plunger element and the internal surface of the air piston barrel.

In embodiments, the internal surface of the air piston barrel has incorporated thereon a resilient ring, wherein the resilient ring forms an airtight seal between the plunger element and the internal surface of the air piston barrel.

In embodiments, the plurality of resilient projectile stoppers comprises a plurality of S-shaped cantilever springs.

In embodiments, the latching assembly is coupled between the plunger element and a trigger assembly, wherein the trigger assembly is adapted to be pulled backward by a user of the toy projectile launcher.

In embodiments, when the trigger assembly is pulled back-ward, the coupling of the latching assembly between the plunger element and trigger assembly is released, and the plunger element is pushed forward by the compression spring to expel air from the internal air chamber through the air nozzle disposed on the front portion of the air piston barrel behind the loaded projectile in the firing position.

In embodiments, the projectiles are foam darts.

In embodiments, a drum for use with a projectile launcher having a launch barrel, an air piston barrel, and an air nozzle, comprises a front element including a plurality of projectile holders, wherein each of the plurality of projectile holders is configured to hold a projectile; a rear element; and a plurality of resilient projectile stoppers, each resilient projectile stopper corresponding to one of the plurality of projectile holders, wherein each resilient projectile stopper has a front surface that is maintained at least partially inside of a corresponding projectile holder and abuts a rear surface of a projectile held in the corresponding projectile holder so as to maintain the projectile within the corresponding projectile holder; wherein each of the plurality of projectile holders has a front opening and a rear opening through which the air nozzle of the projectile launcher can extend, wherein each resilient projectile stopper has a trailing surface configured to be engaged by the air nozzle and, in response to the engagement, to flex away from the corresponding projectile holder and allow the air nozzle to extend through the corresponding projectile holder and push the projectile out of the corresponding projectile holder and into the launch barrel of the projectile launcher, and wherein an outer diameter of the air nozzle is substantially the same as an inner diameter of the corresponding projectile holder so as to maintain an airtight seal from the launch barrel to the air piston barrel.

In embodiments, the drum further comprises at least one notch incorporated on the rear element, the at least one notch adapted for engagement with a hook element of an advancement block of the projectile launcher, wherein, upon engagement between the hook element and the notch, the drum rotates to advance a next projectile holder into a firing position within the projectile launcher.

In embodiments, the drum further comprises a plurality of spring assemblies, each spring assembly anchoring one or more of the plurality of resilient projectile stoppers to the drum.

In embodiments, the plurality of resilient projectile stoppers are composed of a resilient thermoplastic material.

In embodiments, the plurality of resilient projectile stoppers are S-shaped cantilever springs.

In embodiments, the drum is removable from the projectile launcher.

In embodiments, the projectiles are foam darts.

BRIEF DESCRIPTION OF THE DRAWINGS

Exemplary embodiments of the present disclosure will be described with references to the accompanying figures, wherein:

FIG. 18A is a schematic partial cross-sectional front view of a feed cartridge shown in FIG. 17 according to an alternative exemplary embodiment of the present disclosure.

FIG. 18B is a closeup side view of a dart stopper spring element of FIGS. 17 and 18A.

FIG. 18C is a schematic side view of the spring element of FIG. 18B incorporated in the feed cartridge of FIGS. 17 and 18A.

FIGS. 20B and 20C are inset closeup cross-sectional side views illustrating details of the dart stopper spring in the toy launcher and cartridge of FIGS. 17-20A according to an alternative exemplary embodiment of the present disclosure.

DETAILED DESCRIPTION

The present disclosure is generally related to an improved toy launcher with an assembly for sealing a launch barrel to thereby improve the air pressure launch force. To achieve this objective, according to an exemplary embodiment, a toy launcher incorporates internal sealing assemblies for improving airway seals between an air piston assembly and a launch barrel.

Figure 1:
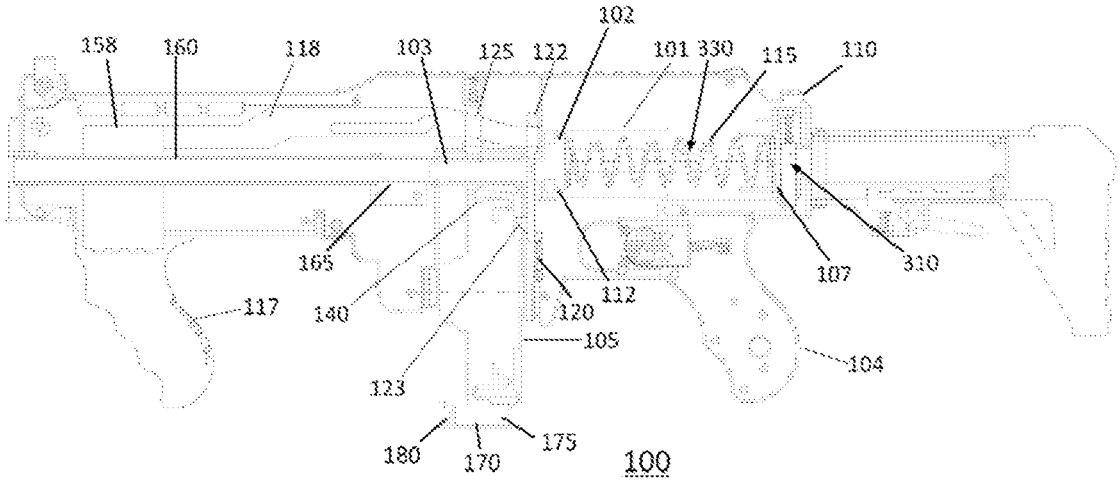
FIG. 1 is a schematic partial cross-sectional side view of key elements of a toy projectile launcher according to an exemplary embodiment of the present disclosure.

FIG. 1 is a schematic partial cross-sectional view of key elements of a toy projectile launcher 100 according to an exemplary embodiment of the present disclosure. For clarity and simplicity in illustrating the key elements and mechanisms of toy projectile launcher 100, portions that are not necessary to understand the scope and the spirit of the present disclosure are not shown. One of ordinary skill in the art would readily understand the supporting elements needed to house and support the various illustrated elements, including those that facilitate the insertion and removal of drum 105 into and out of launcher 100, as well as cartridge assembly 1705 into and out of launcher 1000 (see FIG. 17), with various design choices that would not depart from the spirit and scope of the present disclosure.

FIG. 1 is a schematic side cross-sectional view of a projectile launcher 100 in un-cocked position according to an exemplary embodiment of the present disclosure. As shown in FIG. 1, projectile launcher 100 is shaped to resemble a Thompson submachine gun (or "Tommy gun"). In embodiments, launcher 100 may be in various other shapes and arrangements without departing from the spirit and the scope of the disclosure, as detailed below. As illustrated in FIG. 1, a reciprocating air piston assembly comprised of a barrel 101, a plunger element 102, and a front air nozzle 103 is located above a handle 104 and disposed within a housing 110 of the projectile launcher 100 behind a projectile holding drum 105. According to an exemplary embodiment, barrel 101 of the air piston assembly has a generally rounded cylindrical or an oval cross-sectional shape and plunger element 102 is biased against a back wall 107 of the rear part of launcher housing 110 by a compression spring 115. The plunger element 102 incorporates a size and a shape that correspond with the cross-sectional shape of barrel 101 so as to form an airtight seal with an internal surface of barrel 101. According to an exemplary embodiment of the present disclosure, plunger element 102 incorporates a resilient O-ring 112 (made from a resilient material, such as a polymer) to form an improved seal.

As shown in FIG. 1, barrel 101 is coupled to a cocking slide (front handle) 117 via a reciprocating frame 118 that is fittingly coupled to, along with cocking slide 117, a track (not shown) incorporated in the housing 110 of launcher 100. As will be described in further detail below, reciprocating frame 118 moves back and forth when cocking slide 117 is cocked back and forth in a manner similar to a pump action shotgun, which, in turn, primes the air piston assembly while feeding a foam dart for launch.

As shown in FIG. 1, an extension spring 120 is coupled to a drum advancement block/plate 122 that includes a hook element 123 for engaging a corresponding notch (not shown) on drum 105. As will be described in further detail below, drum 105 for holding projectiles—such as foam darts/bullets and the like—would be advanced by block 122 such that a next projectile would be delivered to a firing position. Correspondingly, a spring-loaded stopper block 125 is incorporated in the top portion of housing 110 for holding drum 105 into an aligned position when drum 105 is advanced via block 122 and hook element 123.

In embodiments, drum 105 may be non-removable from launcher 100. Having a drum 105 as a separable component may be desirable for purposes such as for compact packaging and shipping of launcher 100, or replacing drum 105 as needed or desired (e.g., if broken or for use in launching a different type of projectile, to name a few) or to enable a user to carry a second loaded drum to increase the user's firepower. In alternative embodiments, a retractable rod (not shown) may be used in place of openings on the bottom of launcher 100 to allow drum 105 to be loaded into launcher 100. Correspondingly, cocking slide 117 may be pulled back to the configuration illustrated in FIG. 3A such that air nozzle 103 is retracted from drum 105 and the user may then unload and reload drum 105. Once drum 105 is loaded into launcher 100, the rod may be returned to a closed position to retain drum 105 and, correspondingly, the user may return cocking slide 117 to the forward position illustrated in FIG. 4A to reinsert air nozzle 103 through drum 105 and concurrently prime a next projectile for launch, as will be described in further detail below. In embodiments, the rod may be secured in a closed position with a releasable lock or latch so that drum 105 is not accidentally released from launcher 100. The rod may be retracted from the center of drum 105 to allow drum 105 to be removed. In embodiments, a release button (not shown) or the like may be incorporated in launcher 100 to release the lock or latch. In embodiments, drum 105 may incorporate attachment elements (not shown) for detachably engaging corresponding elements (not shown) in launcher 100 for a rotatable joint that allows for rotating advancement by block 122 and hook element 123, with stopper block 125 ensuring an aligned unitary advancement of drum 105 upon each pull on handle 117 by a user.

In the illustrated embodiment, drum 105 is configured to shoot toy darts. Darts may be loaded into drum 105 before drum 105 is loaded into launcher 100 and/or darts may be loaded and/or refilled in drum 105 after drum 105 is loaded into launcher 100. According to an exemplary embodiment, dart 170, as shown in FIG. 1, has an elongate dart body 175 and a cap 180 that is affixed to the dart body. Dart body 175 has a substantially cylindrical shape and comprises a foam material, or the like, and cap 180 comprises a rubber material, or the like. In embodiments, dart 170 may have a total length, e.g., within a range of approximately 33 mm to 45 mm, such as 35 mm, 36 mm, 37 mm, or 40 mm, to name a few. Correspondingly, dart 170 has an outer cross-sectional diameter at its widest point of 12.9 mm. In alternative embodiments, dart 170 may have an outer cross-sectional diameter at its widest point of, for example, 12.5 mm, 13 mm, 14 mm, or 15 mm, to name a few. In embodiments, dart 170 may incorporate one or more recesses and corresponding ridges on its foam body—for example, as disclosed in U.S. patent application Ser. No. 16/895,172 filed on Jun. 8, 2020, the entire contents of which are incorporated by reference herein.

As shown in FIG. 1 and as will be described in further detail below, drum 105 incorporates an S-shaped cantilever stopper spring 140 for each corresponding projectile holder that is flexible downward to allow nozzle 103 of the air piston assembly to extend from the rear through drum 105 to connect and form a seal with a barrel interface section 165 in front of drum 105. Barrel interface section 165 may be made of metal or other smooth material to reduce friction and enhance the seal with nozzle 103. In embodiments, barrel interface section 165 can be eliminated and instead a longer launch barrel 160 can be utilized.

According to an exemplary embodiment, spring 140 is composed of a resilient thermoplastic material. In embodiments, other suitable resilient materials may be used for providing the flexibility to spring 140 needed to flex away from dart holders 205 (FIG. 2) when nozzle 103 is extended through drum 105, as shown in FIG. 1, and to return to an original configuration to serve as a back stop (or stopper) for darts 170 held in dart holders 205 (FIGS. 3A and 3B) in drum 105. Conventional drums utilize rigid retaining walls at the rear of the drum to retain darts within the drum. When the drums have openings to allow darts to be pushed forward for launching, such openings necessarily have a smaller cross-sectional area than the dart holders of such drums. In an embodiment of the present disclosure, since spring 140 is movable out of dart holder 205 when nozzle 103 moves through dart holder 205, the diameter of air nozzle 103 can be maximized.

As illustrated in FIG. 1, barrel interface section 165 is fixed to housing 110 and includes a rear opening for receiving nozzle 103 and an opposite front opening that connects to launch barrel 160. In embodiments, barrel interface section 165 is fixed to and surrounds at least a portion of launch barrel 160. As will be described in further detail below, barrel interface section 165 forms an airtight connection between air piston nozzle 103 and launch barrel 160 and provides for receiving a primed projectile, such as foam dart 170, into a primed position for launch. Accordingly, a user may pull back cocking slide 117 in order to move the air piston assembly—i.e., barrel 101, plunger element 102, and nozzle 103—backward and to advance drum 105 in a first, pull-back, priming step and the user may then push cocking slide 117 forward, in a second priming step, to push barrel 101 and nozzle 103 forward. As will be described in detail below and shown in FIGS. 3A-4B, a next dart 170-1 held in drum 105 is pushed forward into barrel interface section 165 by nozzle 103 and into a launch position in front of nozzle 103, which forms an airtight seal with barrel interface section 165 behind such a dart 170-1 since the outside diameter of the air nozzle 103 is essentially the same as the inside diameter of the dart holder 205 and the inside diameter of barrel interface section 165.

Figure 2:
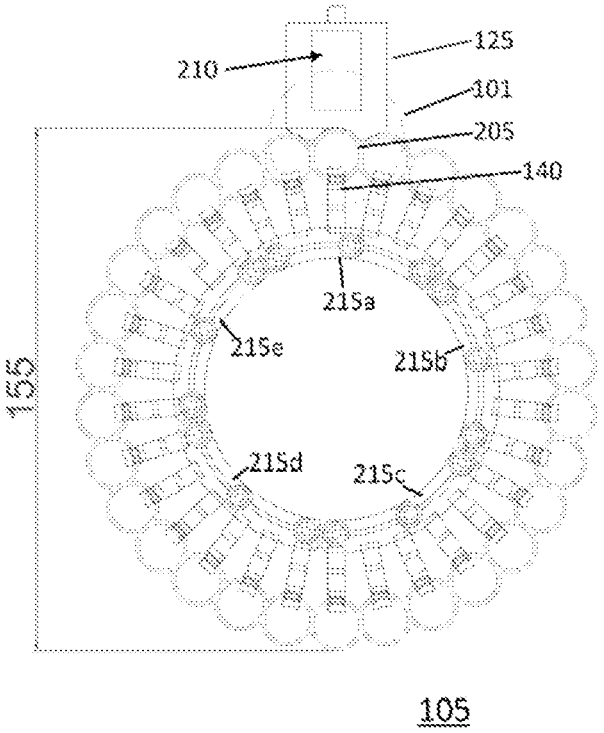
FIG. 2 is a schematic partial cross-sectional front view of a feed drum shown in FIG. 1 according to an exemplary embodiment of the present disclosure.

FIG. 2 is a schematic partial cross-sectional front view of drum 105 shown in FIG. 1 according to an exemplary embodiment of the present disclosure. As shown in FIG. 2, drum 105 includes thirty (30) integrated dart holders 205 around its outer circumference, each dimensioned to accommodate a foam dart 170 (FIG. 1) for use with launcher 100 and through which nozzle 103 is extended to connect to barrel interface section 165 in the arrangement shown in FIG. 1. A drum incorporating a different number of dart holders 205 and/or a different number of rows of dart holders 205 may be used without departing from the spirit and the scope of the present disclosure. For example, in embodiments, drum 105 may incorporate an outer row of forty (40) darts and may further incorporate an additional inner row of darts around an inner circumference of the outer row of darts. An example of a drum incorporating plural rows of darts is disclose in co-pending U.S. patent application Ser. No. 17/038,106. (The contents of U.S. patent application Ser. No. 17/038,106 are incorporated herein by reference.) As further illustrated in FIG. 2, launcher 100 incorporates a spring-loaded stopper block 125 that exerts a downward force on drum 105 with a lower edge that is shaped to hold a dart holder 205—and, thus, drum 105—in alignment. Spring-loaded stopper block 125 incorporates an aperture 210 to provide clearance for reciprocating frame 118 to extend from a front portion to a rear portion of launcher 100, as illustrated in FIG. 1. As will be described below, the outer surface of drum 105 pushes upward to lift stopper block 125 when a user cocks slide handle 117 and advances drum 105.

Additionally, as shown in FIG. 2, S-shaped cantilever spring 140 (as also shown in FIG. 1), which serves as a dart stopper for each dart holder 205, is incorporated and anchored to drum 105 via spring assemblies 215*a-e* that each includes six (6) of the S-shaped springs 140 for respective dart holders 205 on the outer circumference of drum 105. As will be described in further detail below, each S-shaped cantilever spring 140 incorporates a rear-end hook 1405 (see FIG. 3B) with a stop 1410-1 for holding a dart 170 and which rear-end hook 1405 flexes downward (see FIG. 4B) to allow nozzle 103 to extend through dart holder 205. Alternative arrangements and embodiments of cantilever spring 140 will also be described below.

Figure 3A:
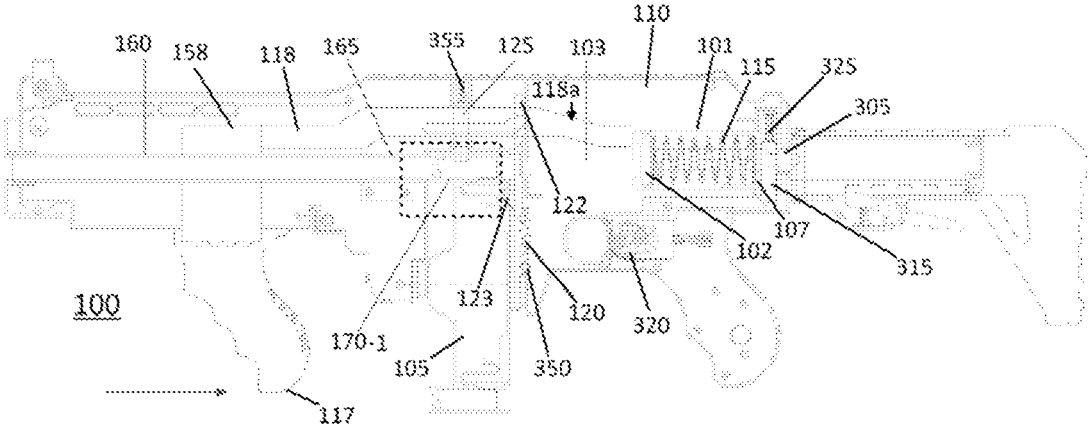
FIG. 3A is a schematic partial cross-sectional side view of the toy projectile launcher of FIG. 1 with a cocking slide or handle being placed in a rearward loading and priming (cocked) position according to an exemplary embodiment of the present disclosure.
Figure 3B:
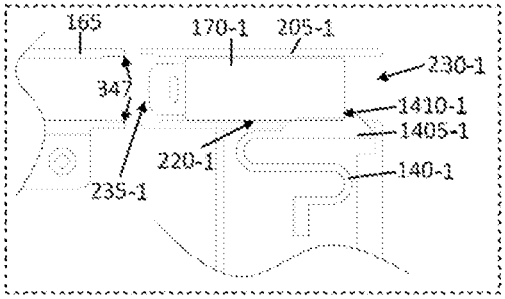
FIG. 3B is an inset closeup cross-sectional side view illustrating details of a dart stopper spring in the toy launcher and drum of FIGS. 1-3A according to an exemplary embodiment of the present disclosure.

FIG. 3A is a schematic partial cross-sectional side view of the toy projectile launcher of FIG. 1 with a handle being placed in a rearward loading and priming (cocked) position according to an exemplary embodiment of the present disclosure. FIG. 3B is an inset closeup cross-sectional side view illustrating details of drum 105 and barrel interface section 165 of FIGS. 1 and 3A according to an exemplary embodiment of the present disclosure.

As shown in FIG. 3A, toy launcher 100 includes barrel 101 with a plunger element 102 that form an air piston assembly. As illustrated in FIG. 3A, barrel 101 is coupled to a sliding handle or cocking slide 117 via reciprocating frame 118 that is coupled to block/frame 158. The coupling between cocking slide 117 and frame 118 via block/frame 158 allows a user to pull back barrel 101 and plunger element 102 in a first, pull-back, priming step. As shown in FIG. 3A, spring 115 is compressed between plunger element 102 and back wall 107. Advantageously, plunger element 102 starts at a position near a front portion of barrel 101, as shown in FIG. 1, and, therefore, compression spring 115 may be fully compressed in the position illustrated in FIG. 3A.

According to an exemplary embodiment of the present disclosure, back wall 107 includes an aperture that allows a dome-shaped rod portion 305 to extend through and past another aperture 310 (FIG. 1) that is incorporated in a spring-loaded plate 315 that is, in turn, coupled to a trigger assembly 320. When a user pulls cocking slide 117 backward in a fashion similar to a pump action rifle (see rearward arrow adjacent cocking slide 117 in FIG. 3A), block/frame 158 pushes on frame 118 so that barrel 101, plunger 102, and rod portion 305 are pushed back as well. Plate 315 is coupled to a compression spring 325 that biases plate 315 downward towards a trigger assembly 320. According to an exemplary embodiment of the disclosure, the leading edge of dome-shaped rod portion 305 is rounded and when it is pushed backward, the rounded leading sloped edge pushes upward on a top edge of aperture 310 (FIG. 1) in plate 315, compressing spring 325, so that rod portion 305 can be pushed through aperture 310 from the front of plate 315 to clear an opposing back side of plate 315, as illustrated in FIGS. 1 and 3A. Once rod portion 305 is pushed sufficiently past plate 315 through aperture 310, spring 325 moves plate 315 downward into engagement with a notch or recess 330 (see FIG. 1) opposite the rounded face of rod portion 305 so that rod portion 305—and, correspondingly, plunger element 102—is engaged with, and temporarily retained in place by plate 315. As shown in FIG. 3A, the notch 330 hooks to the opposing back side of plate 315 above aperture 310 once plate 315 is pushed downwardly by compression spring 325 into notch 330 and, accordingly, a top edge of aperture 310 is pushed into a bottom surface of notch 330 (see FIGS. 1 and 3A)—thus, plate 315, compression spring 325, and notch 330 together form a latching assembly for holding rod portion 305 in the backward position with compression spring 115 fully compressed.

As further shown in FIG. 3A and described above, with plunger element 102 and rod portion 305 pushed back by frame 118, spring 115 is compressed against the back wall 107 of main launcher housing 110 in the position at which plate 315 and notch 330 are hooked and engaged with each other. In alternative embodiments, a structural stop (not shown) may be used to limit the backward motion of cocking slide 117 to the above full extension position—i.e., the engagement position between notch 330 and plate 315.

Correspondingly, with barrel 101 and cocking slide 117 moved back to the configuration shown in FIG. 3A, nozzle 103 is pulled back away from barrel interface section 165 and from one of the dart holders 205 in drum 105 through a rear opening (see 230-1 in FIG. 3B) of dart holder 205, thus clearing the way on the rear end for drum 105 to rotate.

Figure 4A:
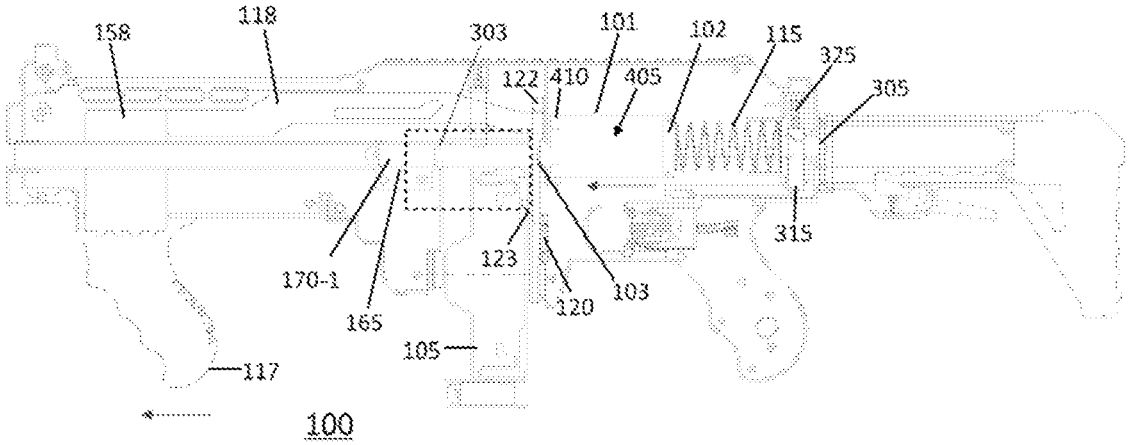
FIG. 4A is a schematic partial cross-sectional side view of the toy projectile launcher of FIG. 3A with the cocking slide or handle being returned to a forward firing position according to an exemplary embodiment of the present disclosure.
Figure 4B:
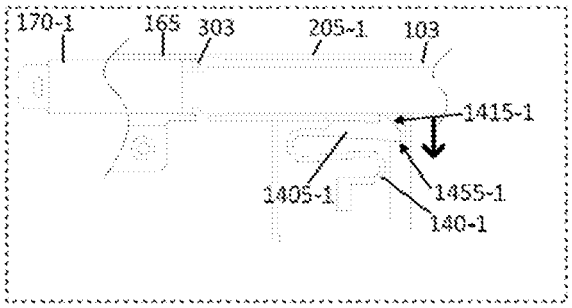
FIG. 4B is an inset closeup cross-sectional side view illustrating details of a dart stopper spring in the toy launcher and drum of FIGS. 1-4A according to an exemplary embodiment of the present disclosure.

Additionally, according to an exemplary embodiment, the rear trailing interior edge of barrel interface section 165 incorporates a rounded taper or flair 347 around the interior circumference of barrel interface section 165, as illustrated in FIG. 3B, to provide additional clearance for priming darts 170 into the firing position shown in FIGS. 4A and 4B, and to avoid possible obstructions to such primings by a cornered edge between dart holder 205 (205-1 in FIG. 3B) of drum 105 and barrel interface section 165.

In substantial synchronization with nozzle 103 being retracted from dart holder 205 (FIGS. 1 and 2) of drum 105, drum 105 is rotated to advance to a next dart holder 205-1 (FIG. 3B). Referring back to FIGS. 1 and 3A, reciprocating frame 118 extends through an aperture in block/plate 122 from the front portion to the rear portion of launcher 100 and a rear portion of reciprocating frame 118 includes an upward sloping surface 118*a* that pushes upward on a top edge of the aperture in block/plate 122 when reciprocating frame is pulled backward from the configuration shown in FIG. 1 to the configuration shown in FIG. 3A. As a result, extension spring 120 is extended from an anchor 350 that is fixed to housing 110 as block 122 and its hook element 123 are moved upward. As described above, hook element 123 engages a corresponding notch (not shown) on a rear surface of drum 105, either on the left side or the right side, in order to move and rotate drum 105—in either a clockwise or counterclockwise direction in the configuration shown in FIG. 2. In embodiments, drum 105 incorporates a ring of notches (not shown) on the rear surface thereof in alignment for engagement with hook element 123. As further described above, the outer surface of drum 105 pushes upward on block 125 as it is being advanced by hook element 123 until a next dart holder 205-1 becomes in substantial alignment with block 125, whereupon compression spring 355 pushes block 125 downward to fit around an outer surface of the next dart holder 205-1 (holding a next dart 170-1 shown in FIG. 3A) for alignment (such alignment being illustrated in FIG. 2).

FIG. 3B is an inset partial cross-sectional closeup view of launcher 100 shown in FIG. 3A, illustrating an individual dart holder 205-1 holding a next dart 170-1 after drum 105 has been rotated upon a pull back on cocking slide 117. As illustrated in FIG. 3B, each dart holder (205-1) includes a main central portion (220-1), which is formed in the shape of a cylinder with a cross-sectional diameter of about 13 mm for fitting and holding the widest point(s) of the foam body of dart 170-1. As further illustrated in FIG. 3B, each holder (205-1) includes an inner rear end opening for spring (140-1) to extend inward so that a hook element (1405-1) thereof forms a front facing flat surface stop (1410-1) to stop the rear end of dart (170-1) and thereby holding dart (170-1) in the main central portion (220-1) of dart holder (205-1) and preventing movement of the dart 170-1 through the rear of the drum during loading. Each hook element (1405-1) serves to abut the rear end of each corresponding dart (170-1) that is loaded into drum 105 by insertion though a front end (235-1) of each dart holder (205-1). According to an exemplary embodiment, launch barrel 160 and barrel interface section 165 each have an inner diameter of approximately 13.26 mm to provide minimal clearance for dart 170, which each has an outer diameter of approximately 13 mm. According to an exemplary embodiment, main portion (220-1), including hook portion (1405-1), has an interior diameter of about 12.9 mm and may be tapered slightly from hook element 1405-1 to front end 235—in other words, having a slightly larger interior circumference towards front end 235—to allow for inserting each dart (170-1) from front end (235-1) to abut front facing surface (1410-1) of hook element (1405-1) and for holding each dart (170-1) in place. As an example, the interior diameter of main portion (220-1) near front end 235 is slightly more than 12.9 mm and the interior diameter of main portion (220-1) near hook element (1405-1) is slightly less than 12.9 mm.

Referring now to FIG. 4A, with the notch/recess 330 (FIG. 1) of rod portion 305 engaged with plate 315 via the downward bias of spring 325, the user can push cocking slide 117 forward in a second priming step—again, in a similar fashion to a pump action rifle—see forward arrow adjacent cocking slide 117 in FIG. 4A. Consequently, barrel 101 is pulled forward (see forward arrow adjacent barrel 101) towards the front of launcher 100 by reciprocating frame 118 while rod portion 305 and plunger element 102 are held in place by plate 315. As shown in FIG. 4A, compression spring 115 remains fully compressed by the return of cocking slide 117 to its original forward position. Accordingly, plunger element 102 forms an air chamber 405 within barrel 101 whereby air is drawn in through front nozzle 103 of barrel 101. In accordance with an exemplary embodiment of the present disclosure, barrel 101 incorporates an additional resilient ring 410 on a rear internal surface thereof to further improve the seal for air chamber 405 and to provide cushioning between the front surface of plunger element 102 and the rear internal surface of barrel 101. Nozzle 103 may be of a substantially smaller diameter than that of the air chamber 405 so that a forward push by plunger 102 would expel the air through nozzle 103 at a higher pressure.

As further shown in FIG. 4A, as the cocking slide 117 is moved forward in the direction shown by the forward arrow, the next dart 170-1 is pushed forward from drum 105 into barrel interface section 165 by nozzle 103, now inserted back into the rear opening of barrel interface section 165 through dart holder 205-1. As described above, launch barrel 160 and barrel interface section 165 each have an internal diameter that provides minimal clearance for darts 170 to allow for substantially airtight propulsion from launch barrel 160 upon release of the pressurized air from air chamber 405.

FIG. 4B is an inset partial cross-sectional closeup view of launcher 100 shown in FIG. 4A, illustrating the next dart 170-1 being pushed forward into a firing position in barrel interface section 165 by nozzle 103. As illustrated in FIG. 4B, as cocking slide 117 is moved forward and as barrel 101 is thereby moved forward, nozzle 103 is pushed forward into dart holder 205-1 and a front edge of nozzle 103 pushes on a slanted trailing surface 1415-1 of hook element 1405-1. Consequently, spring element 140-1 is flexed downward and hook element 1405-1 makes way for nozzle 103 to extend through dart holder 205-1 to barrel interface section 165. As spring element 140-1 is moved completely out of the dart holder 205-1, nozzle 103 can have nearly the same outside diameter as the inside diameter of the dart holder 205 thereby maximizing the diameter of the nozzle 103, in contrast to smaller nozzles for fitting through conventional drums having a reduced diameter due to the use of rigid retaining walls at the rear of a drum. According to an exemplary embodiment, drum 105 incorporates a notch 1455-1 for each dart holder 205-1 to stop the downward movement of hook element 1405-1 and to thereby reduce the stress on spring 140-1 when nozzle 103 is extended through dart holder 205-1. As described above with reference to FIG. 3B, a rear end of barrel interface section 165 incorporates a rounded taper 347 around the interior circumference of barrel interface section 165. As shown in FIG. 4B, the slightly larger interior diameter of the trailing end of barrel interface section 165 serves to receive the front end of nozzle 103 and to thereby form an airtight seal from air piston barrel 101 to the rear end of dart 170-1.

As illustrated in FIGS. 1, 4A, and 4B, nozzle 103 incorporates an O-ring 303 (see FIGS. 4A and 4B) around its outer circumference to form a seal around the internal circumference of the rear opening of barrel interface section 165. Advantageously, an airtight seal is formed from air chamber 405 directly through nozzle 103 to the rear end of dart 170-1, now placed in the firing position in barrel interface section 165, without the need for any connections involving dart holder 205 and, thus, further improving the airtight connection. Additionally, spring 140-1 allows for nozzle 103 to be larger in cross section—for example, having an outer diameter of slightly less than 12.9 mm to fit through main portion 220 of each dart holder 205—so that an airtight seal can be formed with barrel interface section 165 while having an air exit for nozzle 103 that substantially overlaps the rear end of dart 170-1, thus improving the launch force on dart 170-1.

With reciprocating frame 118 being returned to the forward position, block 122, along with hook element 123, are returned to their lowered positions by extension spring 120 and hook element 123 is, thus, aligned to engage a next notch on drum 205.

Figure 5:
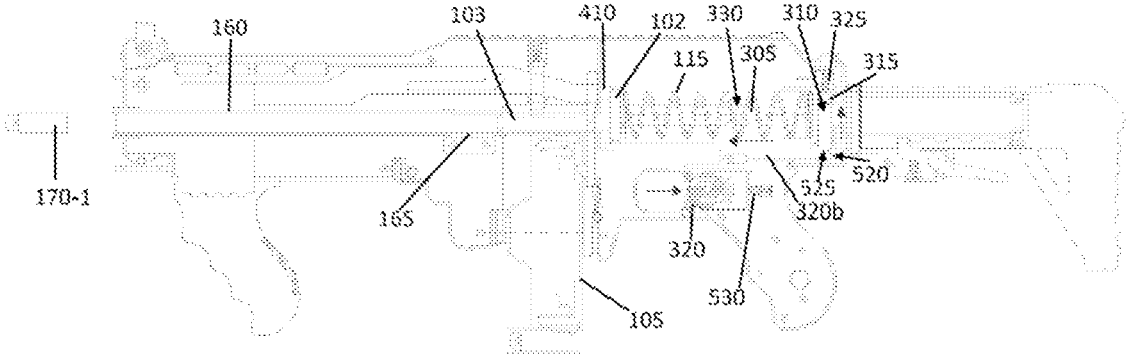
FIG. 5 is a schematic partial cross-sectional side view of the toy projectile launcher of FIG. 4A after a trigger pull illustrating the launch of a foam dart according to an exemplary embodiment of the present disclosure.

Next, a trigger pull and launch action will be described. FIG. 5 illustrates the interface between the rear portion of trigger assembly 320 and locking plate 315. As illustrated in FIG. 5, trigger assembly 320 includes an inclined surface 520 and an upper surface 525—which collectively form a top camming surface of trigger assembly 320 so that, when trigger assembly 320 is pulled backward by the user, locking plate 315 is caused to move upward from inclined surface 520 to the upper surface 525 against spring 325. In embodiments, trigger assembly 320 may be biased forward in a default position by a spring 530, or the like, such that plate 315 returns to contacting the inclined surface 520 when trigger 320 is in the forward, default, non-firing position. Again, a user can pull trigger assembly 320 backward (see backward arrow adjacent trigger 320 in FIG. 5) and, as trigger assembly 320 is slid backwards (see the extension element 320*b* of trigger assembly 320), the rear portion with surfaces 520 and 525, i.e., the top camming surface, is pushed backwards and, accordingly, slides plate 315 upward towards upper surface 525. Consequently, as plate 315 is pushed upward by the top camming surface (surfaces 520 and 525) of trigger assembly 320 (see upward arrow adjacent plate 315 in FIG. 5), the engagement between plate 315 and notch/recess 330 of rod portion 305 is released as aperture 310 is moved upward to a position that clears notch/recess 330. Thus, as illustrated in FIG. 5, spring 115 is released from its fully compressed state thereby driving plunger element 102 forcefully forward (see forward arrow adjacent compression spring 115 in FIG. 5) until the front surface of plunger element 102 abuts cushioning ring 410 on the rear internal surface of barrel 101 to thereby expel the collected air from air chamber 405 through nozzle 103 to launch dart 107-1 through launch barrel 160.

Advantageously, with the airtight seal provided from nozzle 103 to barrel interface section 165 and launch barrel 160, while bypassing dart holder 205, the launch force and velocity for dart 107-1 is improved. Correspondingly, trigger assembly 320 is returned to the forward default position and plate 315 is returned to its lowered position by compression spring 325. According to an exemplary embodiment of the present disclosure, cocking slide 117 may be pulled backward again to the position shown in FIG. 3A to prime a next dart 170 in drum 105 and into the firing position shown in FIG. 4A by a push forward again on cocking slide 117.

Alternatively, trigger assembly 320 may merely incorporate an inclined surface 520 at its rear portion to serve as a camming surface (without requiring plate 315 to reach upper surface 525 shown in FIG. 5) so that as inclined surface 520 is pushed backwards, it slides plate 315 upward until the engagement between plate 315 and notch/recess 330 of rod portion 305 is released as aperture 310 is moved upward to a position that clears notch/recess 330. Additionally, spring 325 described above may be embodied by a spring-loaded arm or a leaf spring (not shown) in an exemplary embodiment of the present disclosure.

Next, various arrangements of the above-described features will be disclosed and illustrated in corresponding figures. Like elements will be referenced with corresponding reference numerals and duplicative descriptions will be omitted.

Figure 6:
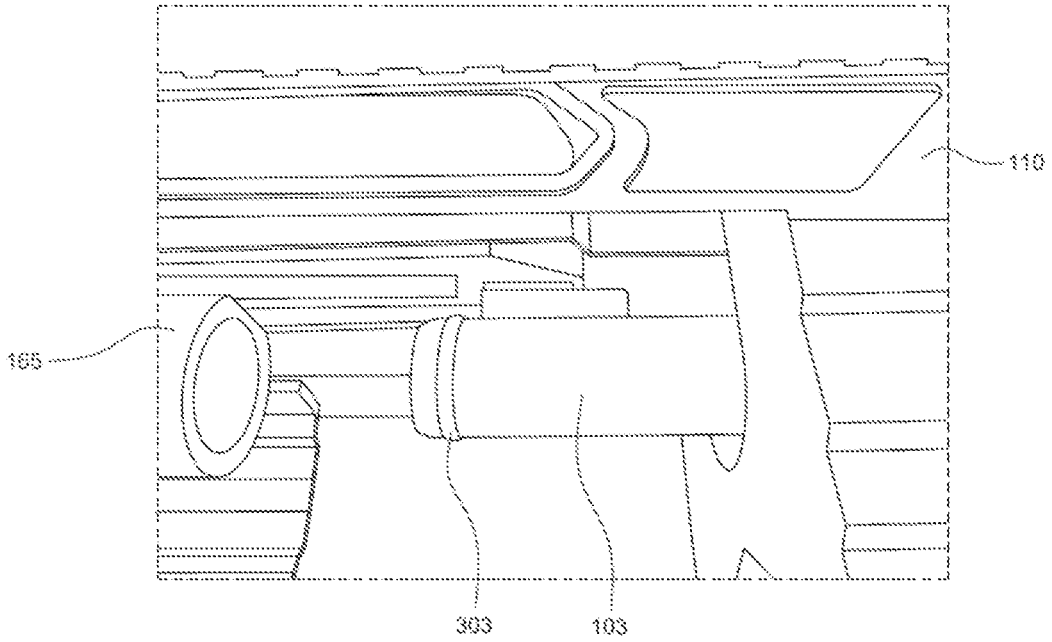
FIG. 6 depicts an exemplary embodiment of a nozzle of the launcher of FIGS. 1-5.

FIG. 6 depicts an exemplary embodiment of nozzle 103 extending forward towards barrel interface section 165 without an inserted drum 105 for illustrating the extension of nozzle 103. As shown, nozzle 103 incorporates O-ring 303.

Figure 7:
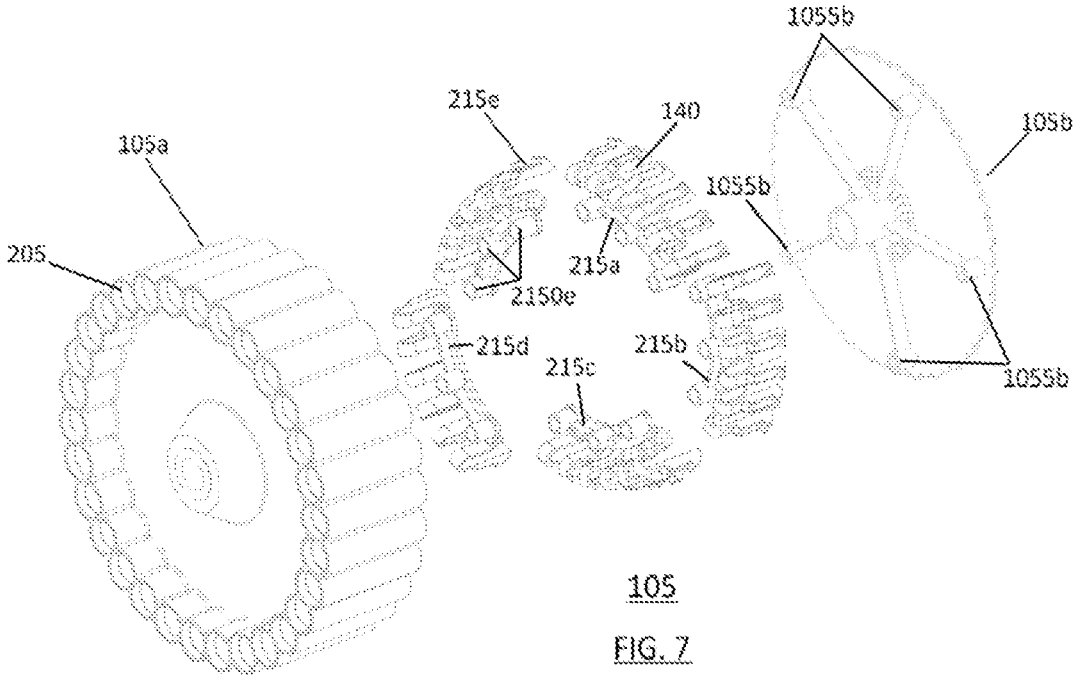
FIG. 7 is an exploded view of the drum shown in FIGS. 1-5 illustrating, in disassembled form, a front element, spring assemblies, and a rear element thereof.

FIG. 7 is an exploded view of drum 105 shown in FIGS. 1-5 illustrating, in disassembled form, a front element 105*a* with dart holders 205, spring assemblies 215*a-e*, and a rear element 105*b*. According to an exemplary embodiment, each of spring assemblies 215*a-e* incorporate six (6) S-shaped springs 140 into singular elements with three (3) fastener openings (2150*e*) for attachment—by respective fasteners, such as screws and the like—to respective corresponding fastener openings (see 2150*b* and 2155*c* in FIG. 10; see also FIG. 8D) on a rear portion of front element 105*a*. As shown in FIG. 7, rear element 105*b* incorporates five (5) fastener openings 1055*b* for attachment—by respective fasteners, such as screws and the like—to respective corresponding fastener openings 1055*a* (FIG. 10) on a rear portion of front element 105*a*.

Figure 8A:
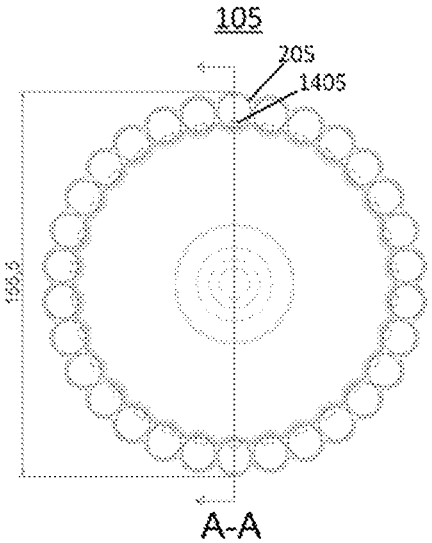
FIG. 8A is a front view of the drum of FIG. 7.
Figure 8B:
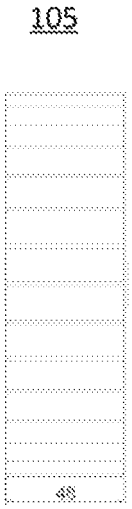
FIG. 8B is a side view of the drum of FIG. 7.
Figure 8C:
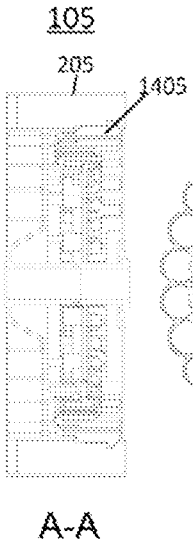
FIG. 8C is a cross-sectional view across the A-A line in FIG. 8A.
Figure 8D:
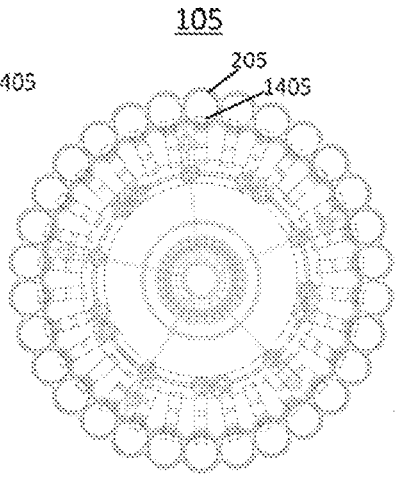
FIG. 8D is a partial cross-sectional rear view of the drum of FIG. 7.

FIG. 8A is a front view of drum 105, FIG. 8B is a side view of drum 105, FIG. 8C is a cross-sectional view across the A-A line in FIG. 8A, and FIG. 8D is a partial cross-sectional rear view of drum 105. FIGS. 8A-8D illustrate the assembled arrangement of the elements shown in FIG. 7 and how hook elements (1405) reach into each dart holder 205 to serve as backstops for loaded darts 170 while providing for nozzle 103 to reach through dart holder 205.

Figure 9A:
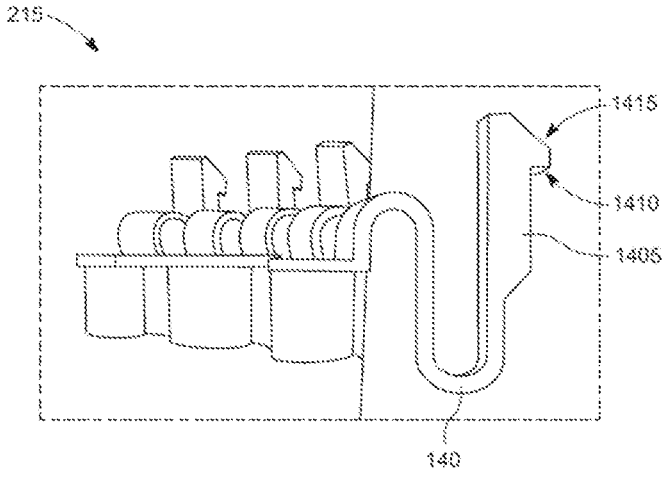
FIGS. 9A and 9B depict an exemplary embodiment of one of the spring assemblies of FIG. 7.

FIG. 9A depicts an exemplary embodiment of spring assembly 215 showing a side view of an S-shaped spring 140 thereof to illustrate hook element 1405, front facing surface 1410, and trailing surface 1415.

Figure 9B:
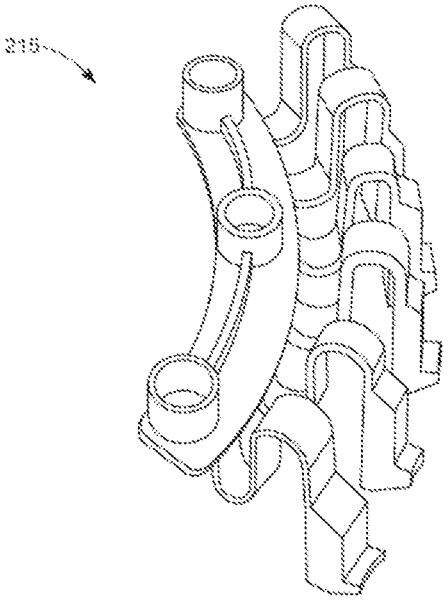

FIG. 9B depicts an exemplary embodiment of spring assembly 215 incorporating six S-shape springs 140 in correspondence with FIGS. 2 and 7-8D.

Figure 10:
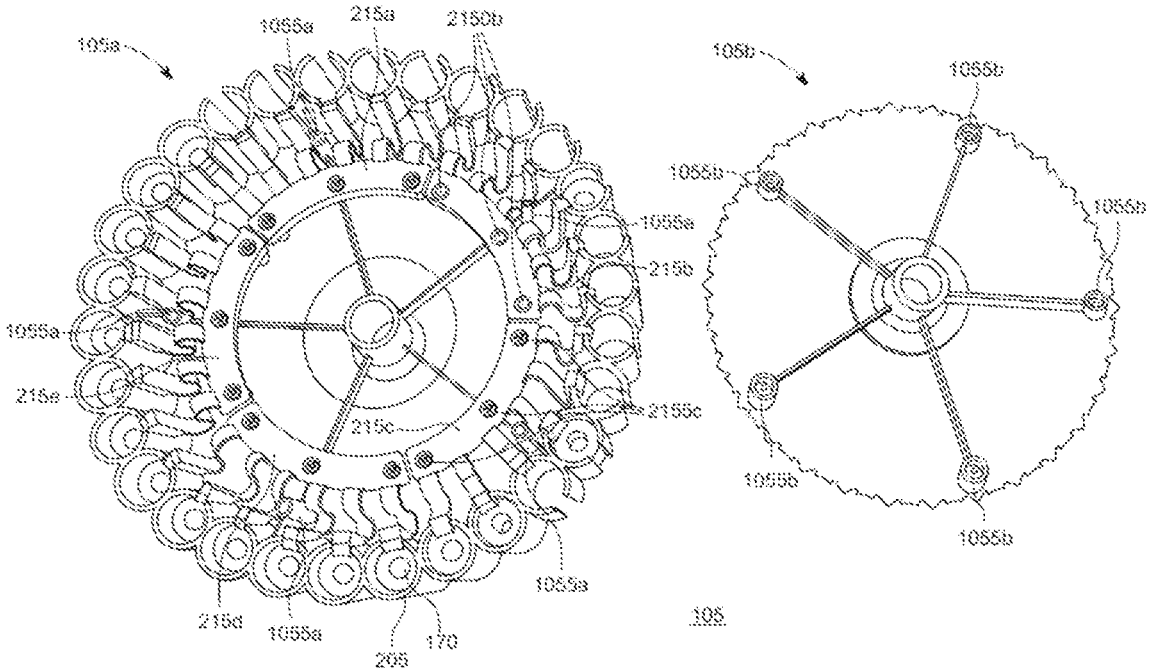
FIG. 10 depicts an exemplary embodiment of the drum of FIG. 7

FIG. 10 depicts an exemplary embodiment of drum 105 with (a front view of) rear element 105*b* disassembled from (a rear view of) front element 105*a* having spring assemblies 215*a-e* incorporated thereto and foam darts 170 inserted into some of the dart holders 205 thereof. As illustrated in FIG. 10, front element 105*a* incorporates five (5) fastener openings 1055*a* for attaching rear element 105*b* thereto by fasteners through the five (5) corresponding fastener openings 1055*b* on rear element 105*b*. FIG. 10 also illustrates the three (3) fastener openings (2150*b*) for each spring assembly 215*a-e* and fasteners (2155*c*) inserted for assemblies 215*a* and 215*c-e*, thereby attached to front element 105*a*.

Figure 11:
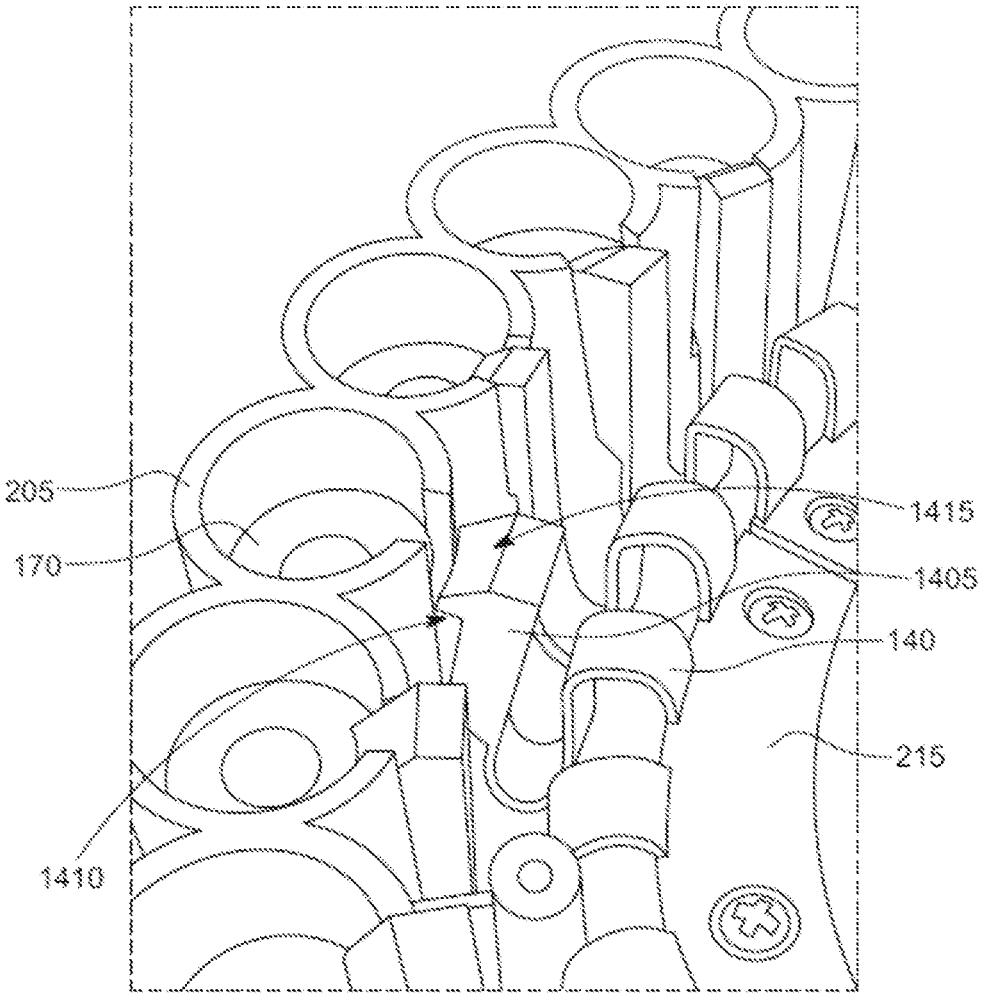
FIG. 11 depicts an exemplary embodiment of the front element of FIG. 7.

FIG. 11 illustrates a downward flex of hook element 1405 and S-shaped spring 140 for accommodating nozzle 103, as described above, in accordance with an exemplary embodiment of the present disclosure.

Figure 12:
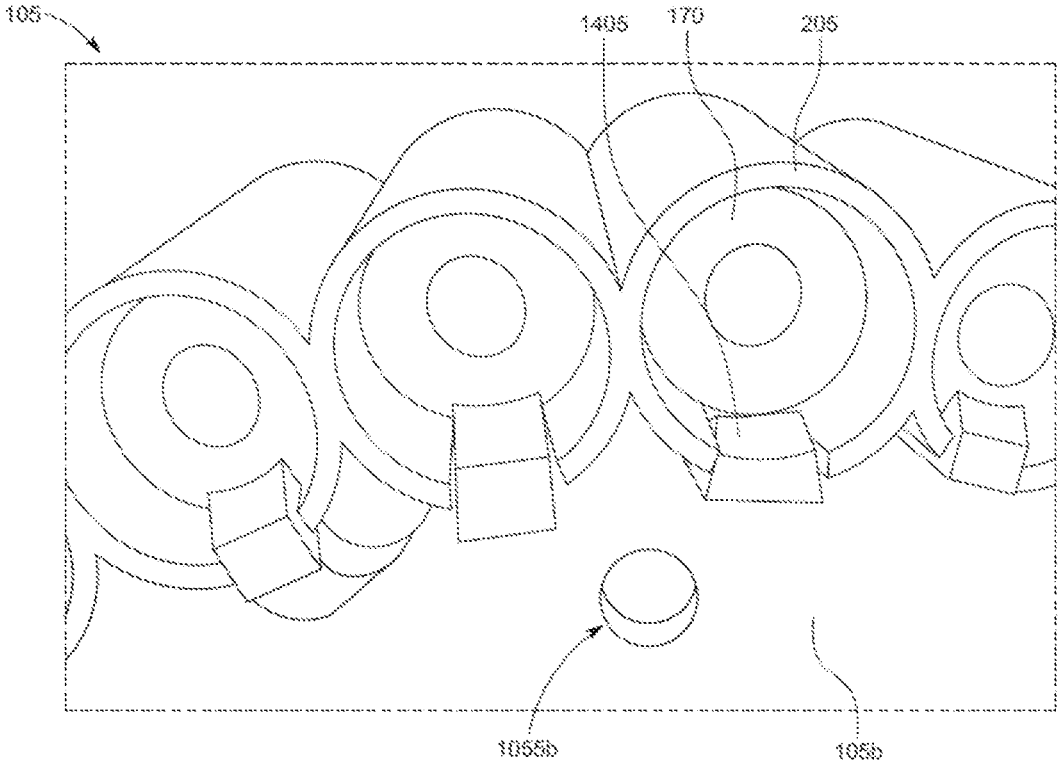
FIG. 12 depicts a rear view of an exemplary embodiment of the drum of FIG. 7.

FIG. 12 depicts a rear view of an assembled drum 105 illustrating the downward flex of hook element 1405 for accommodating the insertion of nozzle 103 (as illustrated in FIG. 6) from the rear of drum 105 through dart holder 205.

Figures 13A, 13B:
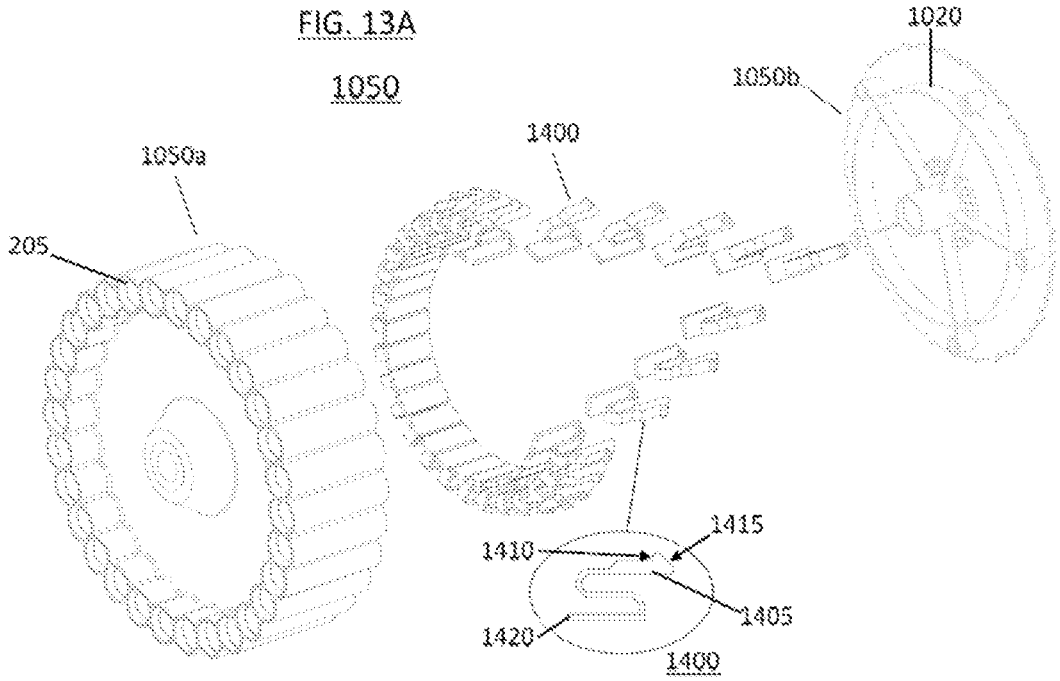
FIG. 13A is an exploded view of a drum according to an alternative exemplary embodiment of the present disclosure illustrating, in disassembled form, a front element, spring elements, and a rear element thereof.
FIG. 13B is an inset closeup view of a spring element of FIG. 13A.

FIG. 13A is an exploded view of a drum 1050 according to an alternative exemplary embodiment wherein an S-shaped spring 1400 for each dart holder 205 is separately incorporated to drum 1050. As shown in FIG. 13A, instead of spring assemblies 215*a-e* each incorporating six (6) springs 140, thirty (30) separate springs 1400 may be incorporated to front element 1050*a* by inserting bottom sections 1420 of each spring 1400 into corresponding slots 1520 (FIG. 14C) in front element 1050*a*. Accordingly, rear element 1050*b* includes a ring 1020 for supporting and holding bottom sections 1420 of each spring 1400 in place while it is inserted into corresponding slots (not shown) in front element 1050*a* when drum 1050 is assembled.

FIG. 13B is a closeup side view of an individual spring 1400 according to this alternative embodiment, with the aforementioned bottom section 1420 for insertion into front element 1050*a* of drum 1050. As illustrated in FIG. 13B, each spring 1400 also incorporates corresponding hook element 1405, front facing surface 1410, and trailing slanted surface 1415 that operate in a similar manner to those of spring 140 described above.

Figure 14A:
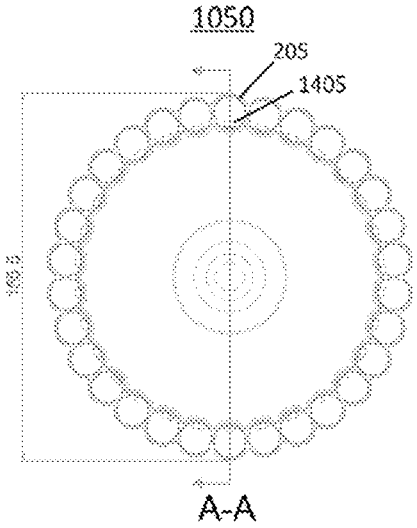
FIG. 14A is a front view of the drum of FIG. 13A.
Figure 14B:
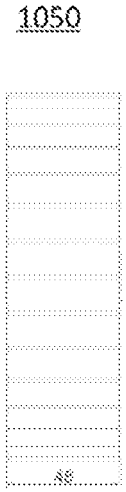
FIG. 14B is a side view of the drum of FIG. 13A.
Figure 14C:
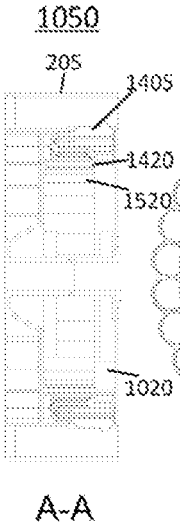
FIG. 14C is a cross-sectional view across the A-A line in FIG. 14A.
Figure 14D:
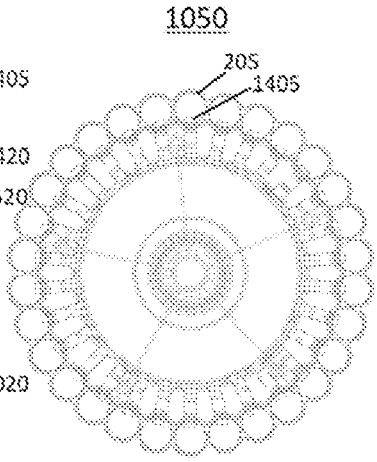
FIG. 14D is a partial cross-sectional rear view of the drum of FIG. 13A.

FIG. 14A is a front view of drum 1050, FIG. 14B is a side view of drum 1050, FIG. 14C is a cross-sectional view across the A-A line in FIG. 14A, and FIG. 14D is a partial cross-sectional rear view of drum 1050. FIGS. 14A-14D illustrate the assembled arrangement of the elements shown in FIGS. 13A and 13B and how hook elements (1405) reach into each dart holder 205 to serve as backstops for loaded darts 170 while providing for nozzle 103 to reach through dart holder 205. As illustrated in FIG. 14C, the bottom section 1420 of each spring 1400 is inserted into a respective slot 1520 in front element 1050*a* of drum 1050 and ring 1020 on rear element 1050*b* abuts the rear end of the bottom sections 1420 of the springs 1400 to hold them in place when drum 1050 is assembled.

Figure 15:
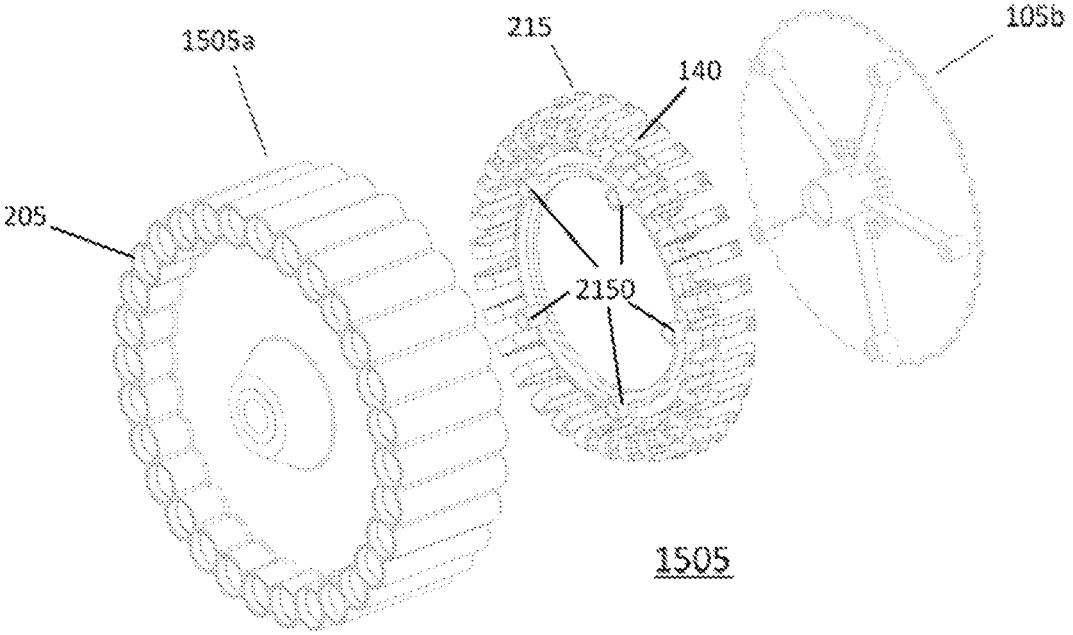
FIG. 15 is an exploded view of a drum according to another alternative exemplary embodiment of the present disclosure illustrating, in disassembled form, a front element, a spring assembly, and a rear element thereof.

FIG. 15 is an exploded view of a drum 1505 illustrating, in disassembled form, a front element 1505*a* with dart holders 205, a singular spring assembly 215, and rear element 105*b* according to another exemplary embodiment of the present disclosure. As shown in FIG. 15, instead of five (5) spring assemblies 215*a-e* each incorporating six (6) S-shaped springs 140, a singular assembly 215 incorporating all thirty (30) springs 140 may be used. According to this embodiment, a simplified construction for front element 1505*a* is provided, where only five (5) fastener openings are needed on the rear portion of front element 1505*a* to accommodate the five (5) fastener openings 2150 of assembly 215 for attachment—by respective fasteners, such as screws and the like—in place of the fifteen (15) corresponding fastener openings (see 2150*b* and 2155*c* in FIG. 10; see also FIG. 8D) needed on the rear portion of front element 105*a*. As shown in FIG. 15, rear element 105*b* for drum 1505 is substantially the same as in drum 105.

Figure 16A:
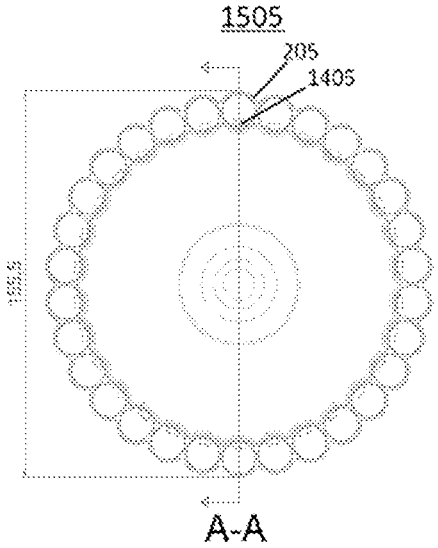
FIG. 16A is a front view of the drum of FIG. 15.
Figure 16B:
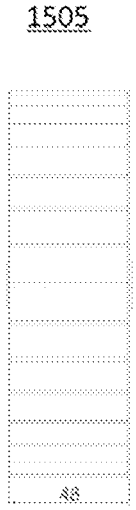
FIG. 16B is a side view of the drum of FIG. 15.
Figure 16C:
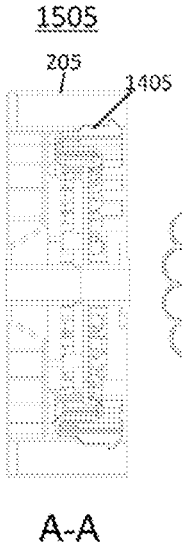
FIG. 16C is a cross-sectional view across the A-A line in FIG. 16A.
Figure 16D:
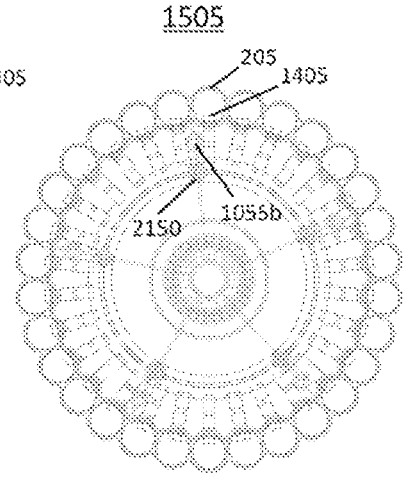
FIG. 16D is a partial cross-sectional rear view of the drum of FIG. 15.

FIG. 16A is a front view of drum 1505, FIG. 16B is a side view of drum 1505, FIG. 16C is a cross-sectional view across the A-A line in FIG. 16A, and FIG. 16D is a partial cross-sectional rear view of drum 1505. FIGS. 16A-16D illustrate the assembled arrangement of the elements shown in FIG. 15 and how hook elements (1405) reach into each dart holder 205 to serve as backstops for loaded darts 170 while providing for nozzle 103 to reach through dart holder 205. As described above and with reference to FIG. 16D, front element 1505*a* of drum 1505 has a simplified construction with five (5) fastener openings for accommodating fastener openings 2150 on spring assembly 215, which are radially aligned with the five (5) fastener openings for accommodating fastener openings 1055*b* on rear element 105*b*.

Figure 17:
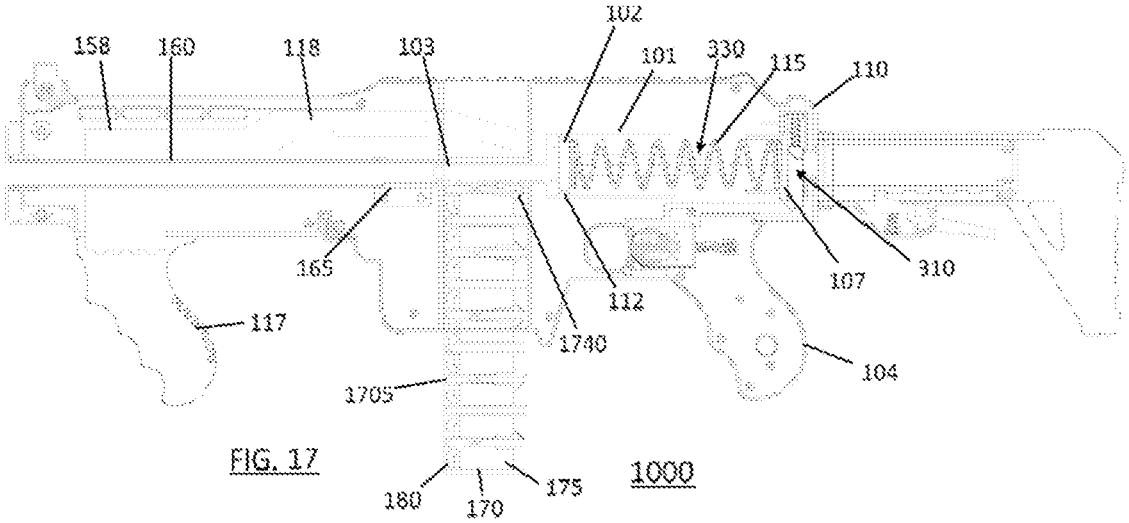
FIG. 17 is a schematic partial cross-sectional side view of key elements of a toy projectile launcher according to an alternative exemplary embodiment of the present disclosure.

Next, an alternative exemplary embodiment of a cartridge or rack assembly 1705 in place of drum 105 will be described with reference to FIGS. 17-21. FIG. 17 illustrates a launcher 1000 incorporating an elongate cartridge 1705 in a vertical arrangement in place of drum 105 of launcher 100 shown in FIG. 1. Launcher 1000 is otherwise substantially similar to launcher 100 and duplicative descriptions of like elements with the same reference numerals will not be repeated.

As shown in FIG. 17, cartridge 1705 incorporates two-pronged spring elements 1740 that serve a similar function to spring element 140 in drum 105—an upper prong of the topmost spring element 1740 is flexed downward to make way for nozzle 103 to connect to barrel interface section 165 in the forward position of cocking slide 117. Similar to spring 140, two-pronged spring 1740 may be composed of a resilient thermoplastic material. In embodiments, other suitable resilient materials may be used for providing the flexibility to spring 1740 needed to flex away from dart holders 205 (FIGS. 20B and 20C) when nozzle 103 is extended through cartridge 1705, as shown in FIG. 17, and to return to an original configuration to serve as a back stop (or stopper) for darts 170 held in dart holders 205 (FIG. 18C) in cartridge 1705. In this embodiment, since spring 1740 can be moved completely out of the dart holder 205, the diameter of air nozzle 103 can be maximized, thus improving the launch force on dart 170.

FIG. 18A is a schematic partial cross-sectional front view of cartridge 1705 shown in FIG. 17 according to an exemplary embodiment of the present disclosure. As shown in FIG. 18A, cartridge 1705 includes ten (10) integrated dart holders 205 arranged along a plane, each dimensioned to accommodate a foam dart 170 (FIG. 17) for use with launcher 1000 and through which nozzle 103 is extended to connect to barrel interface section 165 in the arrangement shown in FIG. 18A. A cartridge incorporating a different number of dart holders 205 and/or a different number of rows of dart holders 205—or in a horizontal or another arrangement—may be used without departing from the spirit and the scope of the present disclosure.

Additionally, as shown in FIGS. 18A-C, two-pronged cantilever spring 1740 (as also shown in FIG. 17), each disposed for two dart holders 205, is incorporated and anchored to cartridge 1705 via, for example, a fastener such as a screw and the like through a fastener opening 1745. Each prong of the two-pronged cantilever spring 1740 incorporates a rear-end hook 1405*a* and 1405*b* (see FIG. 18B) for holding a dart 170 and which rear-end hook 1405*a* and 1405*b* flexes downward and upward, respectively, (see FIGS. 20B and 20C) to allow nozzle 103 to extend through respective dart holders 205. As illustrated in FIG. 18B, each prong of spring 1740 also incorporates a corresponding hook element 1405*a* and 1405*b*, a front facing surface 1410*a* and 1410*b*, and a trailing slanted surface 1415*a* and 1415*b* that operate in a similar manner to those of spring 140 described above, where hook elements 1405*a* and 1405*b* are flexed away from their respective dart holders 205 by nozzle 103 when nozzle 103 is extended forward through the respective dart holders 205 corresponding to hook elements 1405*a* and 1405*b*.

Figure 19:
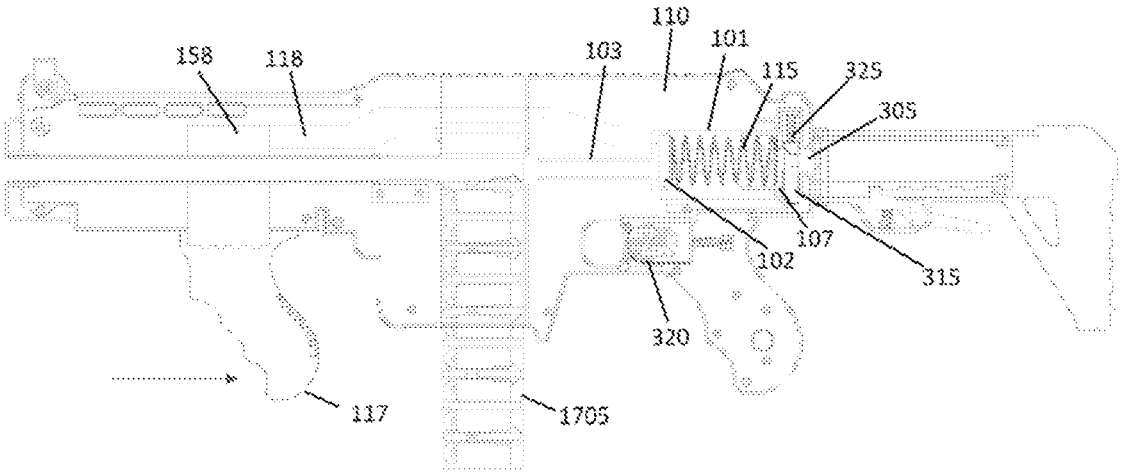
FIG. 19 is a schematic partial cross-sectional side view of the toy projectile launcher of FIG. 17 with a cocking slide or handle being placed in a rearward loading and priming (cocked) position.

FIG. 19 is a partial cross-sectional view of launcher 1000 in a configuration corresponding to FIG. 3A described above with respect to launcher 100. With the exception of drum 105 and its advancement mechanism, launcher 1000 operates in a substantially similar manner when a user pulls back on cocking slide 117 and duplicative description of the air piston assembly of launcher 1000 will not be repeated. As illustrated in FIG. 19, nozzle 103 is retracted from cartridge 1705 when piston barrel 101 is pulled back in correspondence with a pull back on cocking slide 117 by the user, thus clearing the way for cartridge 1705 to advance to a next dart 170.

Figure 20A:
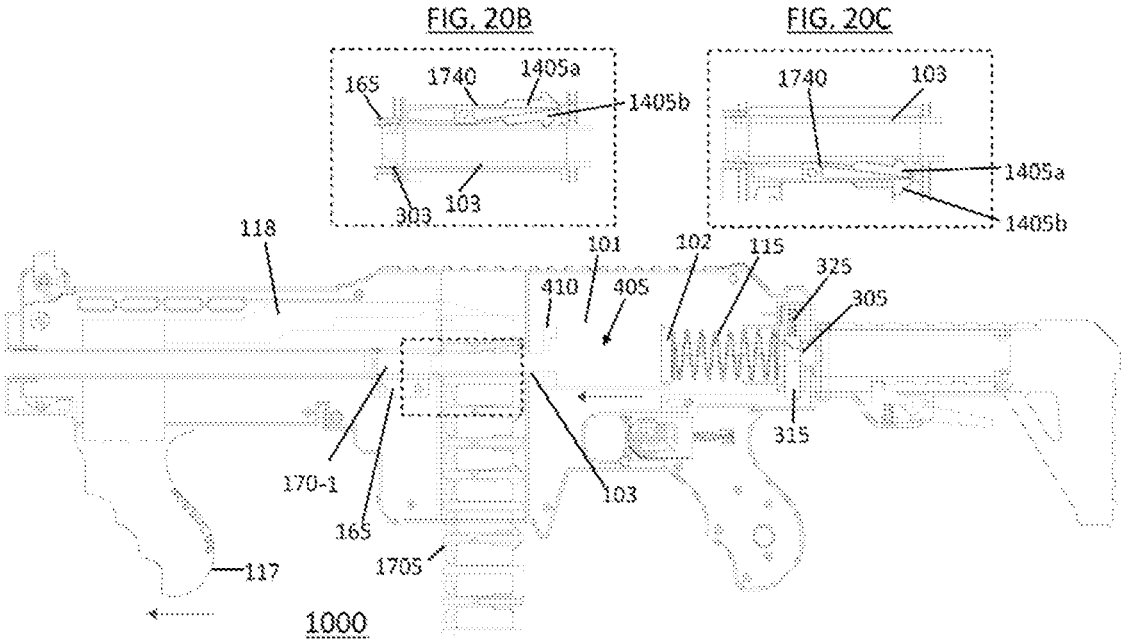
FIG. 20A is a schematic partial cross-sectional side view of the toy projectile launcher of FIG. 19 with the cocking slide or handle being returned to a forward firing position.

FIG. 20A is a partial cross-sectional view of launcher 1000 in a configuration corresponding to FIG. 4A described above with respect to launcher 100. As shown in FIG. as cocking slide 117 is returned to the forward position, cartridge 1705 is advanced upward to a next dart holder 205 by an advancement mechanism (not shown) coupled to cocking slide 117. In substantial synchronization, nozzle 103 is pulled forward through the next dart holder 205 and pushes the next dart 170-1 held therein forward into barrel interface section 165, in a manner similar to launcher 100 described above and illustrated in FIG. 4A. FIG. 20B is an inset closeup side view of the nozzle 103 inserted through the dart holder 205 in cartridge 1705 for dart 170-1 corresponding to the configuration shown in FIG. 20A. FIG. also provides a closeup view of the airtight seal formed between nozzle 103 and barrel interface section 165 by O-ring 303 in a manner similar to launcher 100 and of hook element 1045*b* flexing upward to make way for nozzle 103. For contrast, FIG. 20C is a closeup view illustrating hook element 1045*a* flexing downward to make way for nozzle 103, which corresponds to either the configuration shown in FIG. 17 or one in which the user has fired dart 170-1 and cocked cocking slide 117 again to prime a next dart 170. Thus, hook elements 1045*a* and 1045*b* of springs 1740 in cartridge 1705 make way for nozzle 103 in an alternating fashion as cartridge 1705 is advanced to a next dart.

Figure 21:
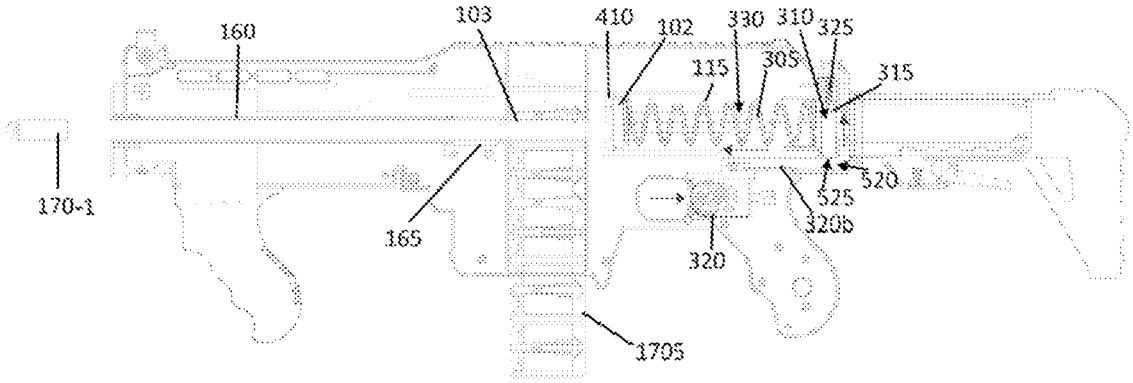
FIG. 21 is a schematic partial cross-sectional side view of the toy projectile launcher of FIG. 20A after a trigger pull illustrating the launch of a foam dart.

FIG. 21 illustrates the interface between the rear portion of trigger assembly 320 and locking plate 315 of launcher 1000 during a trigger pull. The launching of dart 170-1 by launcher 1000 shown in FIG. 21 operates in a substantially similar manner as launcher 100 described above and illustrated in FIG. 5. Thus, duplicative description of like elements with the same reference numerals will not be repeated.

Although the exemplary embodiment is described in the context of a foam bullet/dart launcher that utilizes shortened foam bullets/darts, it is to be understood that the two-step priming/loading and firing action according to the present disclosure could be applied to a toy projectile launcher of other types of projectiles (e.g., a ball or the like) or a fluid launcher whereby the fluid from a reservoir in the handle is driven by a plunger. In such environment the two-step priming/pumping action of the present disclosure enables a handheld high-velocity fluid burst launcher.

While particular embodiments of the present disclosure have been shown and described in detail, it would be obvious to those skilled in the art that various modifications and improvements thereon may be made without departing from the spirit and scope of the disclosure. It is therefore intended to cover all such modifications and improvements that are within the scope of this disclosure.

What is claimed is:

1. A toy projectile launcher, comprising:

a projectile container containing a plurality of projectile holders, each projectile holder configured to contain a loaded projectile, wherein the projectile container includes a plurality of resilient projectile stoppers, wherein each resilient projectile stopper abuts a portion of a respective projectile loaded in a respective projectile holder;

a cocking slide that is adapted to be moved forward and backward; and a housing, the housing having disposed therein:

a launch barrel;

an air piston assembly, the air piston assembly including an air piston barrel having an air nozzle disposed on a front portion thereof, a plunger element, and a compression spring;

wherein the projectile container, the launch barrel, and the air piston assembly are each coupled to the cocking slide;

wherein, when the cocking slide is moved backward from a forward position to a backward position:

a front portion of the air piston barrel moves backward and pushes the plunger element to compress the compression spring against a rear wall of the housing, wherein the plunger element and compression spring are held in place by a latching mechanism; and a projectile advancement mechanism engages the projectile container and advances a next projectile holder containing a loaded projectile into a firing position in front of the air piston barrel; and wherein, when the cocking slide is moved forward from the backward position to the forward position:

the front portion of the air piston barrel moves forward, forming an internal air chamber between the front portion of the air piston barrel and the plunger element; and the air nozzle moves forward to form an airtight seal between the air piston barrel and the launch barrel, wherein a front portion of the air nozzle engages a trailing surface of one of the plurality of resilient projectile stoppers, wherein, upon said engagement by the front portion of the air nozzle, the one of the plurality of resilient projectile stoppers flexes outward to allow the front portion of the air nozzle to extend through the next projectile holder, wherein the front portion of the air nozzle pushes the loaded projectile in the next projectile holder from the next projectile holder into the launch barrel, and wherein the front portion of the air nozzle connects to the launch barrel to form an airtight seal between the air piston barrel and the launch barrel.

2. The toy projectile launcher of claim 1, wherein the front portion of the air nozzle pushes the loaded projectile from the next projectile holder into a firing position in front of the airtight seal between the launch barrel and the air piston barrel.

3. The toy projectile launcher of claim 1, wherein the plunger element is sized to form an airtight seal with an internal surface of the air piston barrel.

4. The toy projectile launcher of claim 3, wherein the plunger element incorporates a resilient O-ring to form the airtight seal between the plunger element and the internal surface of the air piston barrel.

5. The toy projectile launcher of claim 3, wherein the internal surface of the air piston barrel has incorporated thereon a resilient ring, wherein the resilient ring forms an airtight seal between the plunger element and the internal surface of the air piston barrel.

6. The toy projectile launcher of claim 1, wherein the plurality of resilient projectile stoppers comprises a plurality of S-shaped cantilever springs.

7. The toy projectile launcher of claim 1, wherein the latching assembly is coupled between the plunger element and a trigger assembly, wherein the trigger assembly is adapted to be pulled backward by a user of the toy projectile launcher.

8. The toy projectile launcher of claim 7, wherein, when the trigger assembly is pulled backward, the coupling of the latching assembly between the plunger element and trigger assembly is released, and the plunger element is pushed forward by the compression spring to expel air from the internal air chamber through the air nozzle disposed on the front portion of the air piston barrel behind the loaded projectile in the firing position.

9. The toy projectile launcher of claim 1, wherein the projectiles are foam darts.

10. A toy projectile launcher, comprising:

a projectile container containing a plurality of projectile holders, each projectile holder configured to contain a loaded projectile, wherein the projectile container includes a plurality of resilient projectile stoppers, wherein each resilient projectile stopper abuts a portion of a respective projectile loaded in a respective projectile holder;

a cocking slide that is adapted to be moved forward and backward; and a housing, the housing having disposed therein:

a launch barrel;

a launch barrel interface section coupled to the launch barrel; and an air piston assembly, the air piston assembly including an air piston barrel having an air nozzle disposed on a front portion thereof, a plunger element, and a compression spring;

wherein the projectile container, the launch barrel, and the air piston assembly are each coupled to the cocking slide;

wherein, when the cocking slide is moved backward from a forward position to a backward position:

a front portion of the air piston barrel moves backward and pushes the plunger element to compress the compression spring against a rear wall of the housing, wherein the plunger element and compression spring are held in place by a latching mechanism; and a projectile advancement mechanism engages the projectile container and advances a next projectile holder containing a loaded projectile into a firing position in front of the air piston barrel; and wherein, when the cocking slide is moved forward from the backward position to the forward position:

the front portion of the air piston barrel moves forward, forming an internal air chamber between the front portion of the air piston barrel and the plunger element; and a front portion of the air nozzle forms an airtight connection with the launch barrel via an airtight seal between the launch barrel interface section and the front portion of the air nozzle, wherein the front portion of the air nozzle engages a trailing surface of one of the plurality of resilient projectile stoppers, wherein, upon said engagement by the front portion of the air nozzle, the one of the plurality of resilient projectile stoppers flexes outward to allow the front portion of the air nozzle to extend through the next projectile holder, wherein the front portion of the air nozzle pushes the loaded projectile in the next projectile holder from the next projectile holder into the launch barrel interface section.

11. The toy projectile launcher of claim 10, wherein the front portion of the air nozzle pushes the loaded projectile from the next projectile holder into a firing position in the launch barrel interface section in front of the airtight seal between the launch barrel interface section and the air nozzle.

12. The toy projectile launcher of claim 11, wherein the launch barrel interface section has a rounded taper at a rear trailing interior edge thereof.

13. The toy projectile launcher of claim 12, wherein the air nozzle has incorporated thereon an O-ring around an outer circumference of the air nozzle, wherein the O-ring of the air nozzle forms a seal around an internal circumference of the launch barrel interface section.

14. The toy projectile launcher of claim 10, wherein the plunger element is sized to form an airtight seal with an internal surface of the air piston barrel.

15. The toy projectile launcher of claim 14, wherein the plunger element incorporates a resilient O-ring to form the airtight seal between the plunger element and the internal surface of the air piston barrel.

16. The toy projectile launcher of claim 14, wherein the internal surface of the air piston barrel has incorporated thereon a resilient ring, wherein the resilient ring forms an airtight seal between the plunger element and the internal surface of the air piston barrel.

17. The toy projectile launcher of claim 10, wherein the plurality of resilient projectile stoppers comprises a plurality of S-shaped cantilever springs.

18. The toy projectile launcher of claim 10, wherein the latching assembly is coupled between the plunger element and a trigger assembly, wherein the trigger assembly is adapted to be pulled backward by a user of the toy projectile launcher.

19. The toy projectile launcher of claim 18, wherein, when the trigger assembly is pulled backward, the coupling of the latching assembly between the plunger element and trigger assembly is released, and the plunger element is pushed forward by the compression spring to expel air from the internal air chamber through the air nozzle disposed on the front portion of the air piston barrel behind the loaded projectile in the firing position.

20. The toy projectile launcher of claim 10, wherein the projectiles are foam darts.

21. A drum for use with a projectile launcher, the projectile launcher having a launch barrel, an air piston barrel, and an air nozzle, the drum comprising:

a front element including a plurality of projectile holders, wherein each of the plurality of projectile holders is configured to hold a projectile;

a rear element; and a plurality of resilient projectile stoppers, each resilient projectile stopper corresponding to one of the plurality of projectile holders, wherein each resilient projectile stopper has a front surface that is maintained at least partially inside of a corresponding projectile holder and abuts and is in direct contact with a rear surface of a projectile held in the corresponding projectile holder so as to maintain the projectile within the corresponding projectile holder;

wherein each of the plurality of projectile holders has a front opening and a rear opening through which the air nozzle of the projectile launcher can extend, wherein each resilient projectile stopper has a trailing surface configured to be engaged by the air nozzle and, in response to the engagement, to flex away from the corresponding projectile holder and allow the air nozzle to extend through the corresponding projectile holder and push the projectile out of the corresponding projectile holder and into the launch barrel of the projectile launcher, and wherein an outer diameter of the air nozzle is substantially equal to an inner diameter of the corresponding projectile holder so as to maintain an airtight seal from the launch barrel to the air piston barrel.

22. The drum of claim 21, further comprising:

at least one notch incorporated on the rear element, the at least one notch adapted for engagement with a hook element of an advancement block of the projectile launcher, wherein, upon engagement between the hook element and the notch, the drum rotates to advance a next projectile holder into a firing position within the projectile launcher.

23. The drum of claim 21, further comprising a plurality of spring assemblies, each spring assembly anchoring one or more of the plurality of resilient projectile stoppers to the drum.

24. The drum of claim 21, wherein the plurality of resilient projectile stoppers are composed of a resilient thermoplastic material.

25. The drum of claim 21, wherein the plurality of resilient projectile stoppers are S-shaped cantilever springs.

26. The drum of claim 21, wherein the drum is removable from the projectile launcher.

27. The drum of claim 21, wherein the projectiles are foam darts.

* * * * *